US010657872B2

(12) United States Patent
Tien et al.

(10) Patent No.: US 10,657,872 B2
(45) Date of Patent: May 19, 2020

(54) DISPLAY DEVICE

(71) Applicant: AU OPTRONICS CORPORATION, Hsin-chu (TW)

(72) Inventors: Kun-Cheng Tien, Hsin-chu (TW); Chien-Huang Liao, Hsin-chu (TW); Jia-Long Wu, Hsin-chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 92 days.

(21) Appl. No.: 15/782,507

(22) Filed: Oct. 12, 2017

(65) Prior Publication Data

US 2018/0114478 A1 Apr. 26, 2018

(30) Foreign Application Priority Data

Oct. 21, 2016 (TW) ..... 105134186 A

(51) Int. Cl.

*G09G 3/20* (2006.01)
*G09G 5/02* (2006.01)
*G09G 3/36* (2006.01)

(52) U.S. Cl.

CPC ..... *G09G 3/2074* (2013.01); *G09G 3/3614* (2013.01); *G09G 5/02* (2013.01);
(Continued)

(58) Field of Classification Search

CPC .. G09G 3/2074; G09G 3/2003; G09G 3/3607; G09G 3/3685; G09G 3/364;
(Continued)

(56) References Cited

U.S. PATENT DOCUMENTS

2007/0046607 A1 3/2007 Lai
2008/0088559 A1 4/2008 Lai et al.
(Continued)

FOREIGN PATENT DOCUMENTS

CN 1731503 A 2/2006
CN 1959777 A 5/2007
(Continued)

OTHER PUBLICATIONS

Office Action issued by the State Intellectual Property Office of the Peoples Republic of China dated May 24, 2019 for Application No. CN201710309185.8.

*Primary Examiner* — Nitin Patel
(74) *Attorney, Agent, or Firm* — Tim Tingkang Xia, Esq.; Locke Lord LLP

(57) ABSTRACT

A display device includes a plurality of gate lines, configured to output corresponding scan signals to corresponding pixels; a plurality of data lines, configured to receive display data and output corresponding pixel voltages to corresponding pixels, where the plurality of data lines includes 12 successive data lines from left to right; a gate driver, electrically coupled to the gate lines, configured to drive the pixels; and a data driver, electrically coupled to the data lines, configured to provide data signals to the pixels, where the data driver respectively provides data with polarities of: positive, negative, positive, negative, positive, negative, negative, positive, negative, positive, negative, and positive to the 12 data lines, and each column of pixels includes pixels in two forms; when the display data has a same gray scale, the data driver respectively provides two different pixel voltages to the pixels in two forms.

13 Claims, 28 Drawing Sheets

(52) U.S. Cl.
CPC ..... *G09G 5/026* (2013.01); *G09G 3/3666* (2013.01); *G09G 2300/0452* (2013.01); *G09G 2320/0219* (2013.01); *G09G 2320/0238* (2013.01); *G09G 2320/0242* (2013.01); *G09G 2320/0276* (2013.01); *G09G 2320/068* (2013.01); *G09G 2320/0666* (2013.01); *G09G 2320/0673* (2013.01)

(58) Field of Classification Search
CPC .... G09G 3/3659; G09G 3/2007; G09G 3/207; G09G 3/2077; G09G 3/3614; G09G 2320/0242; G09G 2320/0233; G09G 2320/0276; G09G 2320/0271; G09G 2320/066; G09G 2320/0238; G09G 2320/0673; G09G 2320/0209; G09G 2320/0686; G09G 2320/0285; G09G 2320/028; G09G 2320/0666; G09G 2300/0452; G09G 2300/0426; G09G 2300/0439; G09G 2300/0443; G09G 2300/0447; G09G 2310/027; G09G 2310/0254; G09G 2310/0256; G09G 2310/0251; G09G 5/02; G09G 5/026
See application file for complete search history.

(56) References Cited

U.S. PATENT DOCUMENTS

2009/0040243 A1* 2/2009 Hisada ..... G09G 3/3614 345/690
2011/0254759 A1* 10/2011 Mori ..... G09G 3/3607 345/88
2012/0120130 A1* 5/2012 Tang ..... G09G 3/3648 345/694
2013/0257829 A1* 10/2013 Moh ..... G09G 3/36 345/204
2013/0271436 A1* 10/2013 Shiomi ..... G09G 3/3648 345/204
2014/0111556 A1* 4/2014 Chen ..... G09G 3/20 345/690
2015/0348481 A1* 12/2015 Hong ..... G09G 3/3614 345/690
2016/0035292 A1* 2/2016 Lee ..... G09G 3/3648 345/694
2016/0055808 A1* 2/2016 Guo ..... G09G 3/3607 345/694
2016/0071473 A1* 3/2016 Ahn ..... G09G 3/3614 345/690
2016/0246136 A1* 8/2016 Lim ..... G09G 3/3607
2016/0299391 A1* 10/2016 Liu ..... G02F 1/134336
2016/0351137 A1* 12/2016 Lee ..... G09G 3/3611
2017/0053586 A1* 2/2017 Chen ..... G09G 3/2074
2017/0116934 A1* 4/2017 Tien ..... G09G 3/364
2017/0139294 A1* 5/2017 Kim ..... G02F 1/136286
2018/0053461 A1 2/2018 Tien et al.
2018/0182328 A1* 6/2018 Hwang ..... G09G 3/3614
2018/0211580 A1* 7/2018 Su ..... G09G 3/3607
2018/0239207 A1* 8/2018 Ying ..... G02F 1/136286
2018/0350317 A1* 12/2018 Shin ..... G09G 3/3614

FOREIGN PATENT DOCUMENTS

CN 105304010 A 2/2016
CN 106328039 A 1/2017
TW I570687 B 2/2017

* cited by examiner

| | |
|---|---|
| PH (V1) | PL (V3) |
| PL (V3) | PI (V2) |

Display d1

$V1 > V2 \geqq V3$

FIG. 4

| | |
|---|---|
| PH (V4) | PL (V5) |
| PL (V5) | PI (V4) |

Display d2

$V4 > V5$

FIG. 5

| | | | |
|---|---|---|---|
| VH | | | |
| | VH | | |
| | | | VH |
| | | VH | |

FIG. 14B

| | | | |
|---|---|---|---|
| VH | | | |
| | VH | | |
| | | | VH |
| | | VH | |

FIG. 17B

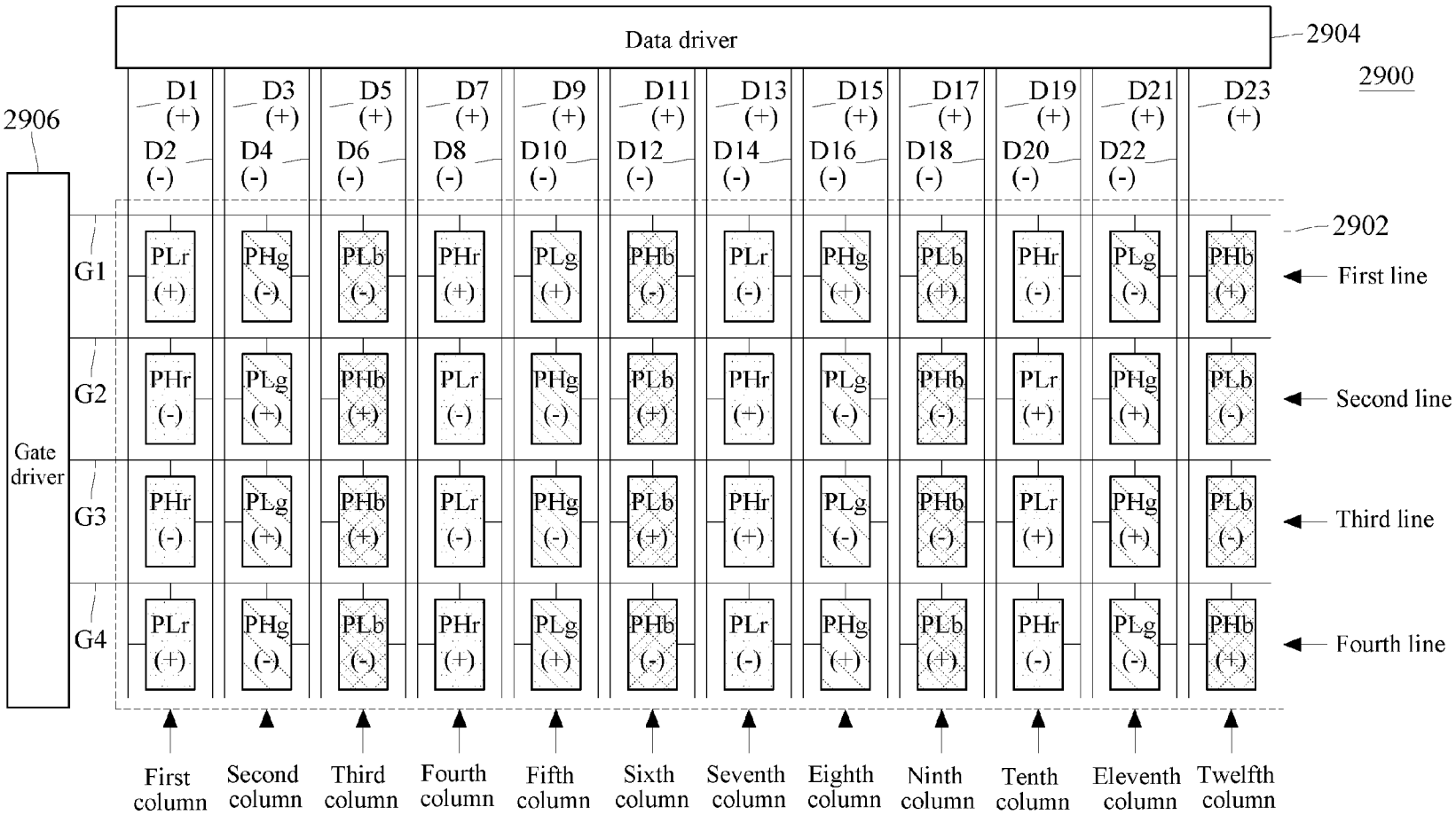
2900
2904
Data driver
2902
First line
Second line
Third line
Fourth line
D1 (+)
D2 (-)
D3 (+)
D4 (-)
D5 (+)
D6 (-)
D7 (+)
D8 (-)
D9 (+)
D10 (-)
D11 (+)
D12 (-)
D13 (+)
D14 (-)
D15 (+)
D16 (-)
D17 (+)
D18 (-)
D19 (+)
D20 (-)
D21 (+)
D22 (-)
D23 (+)
PLr (+)
PHg (-)
PLb (-)
PHr (+)
PLg (+)
PHb (-)
PLr (-)
PHr (+)
PLg (-)
PHb (+)
PLb (+)
PHg (-)
PLr (+)
PHr (-)
PLg (-)
PHb (+)
PLb (-)
PHg (+)
PLr (-)
PHr (+)
PLg (+)
PHb (-

DISPLAY DEVICE

CROSS-REFERENCE TO RELATED PATENT APPLICATION

This application claims priority to and the benefit of, pursuant to 35 U.S.C. § 119(a), patent application Ser. No. 10/5,134,186 filed in Taiwan on Oct. 21, 2016. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to a display device, and in particular, to a display device that improves color washout.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

To improve the color washout (color washout) problem of a side viewing angle of a display device, a single subpixel is generally divided into two areas, called a main subpixel area and a secondary subpixel area, and a suitable circuit driving architecture is matched to make pixel voltages of the two areas of the subpixel different. Therefore, the single subpixel can display two brightnesses, so as to improve the color washout problem of the side viewing angle.

To satisfy requirements for image fineness of consumers, display devices develop towards a direction of high resolution. If the foregoing subpixel partitioning technology is used in a display device with high resolution, as a consequence, a penetration rate of the display device is reduced. For example, when M×N pixel units receive display data with a resolution of M×N, a charge sharing circuit may need M scan lines and M charge sharing control lines to make pixel voltages of two areas of a subpixel different.

Although some technology has attempted to improve the foregoing problem by using special pixel configuration, in the special pixel configuration, how to avoid influences of V-lines (V-line) or crosstalks (crosstalk) on display quality is a more important topic for discussion.

SUMMARY

A display device disclosed in the present invention comprises a plurality of gate lines, configured to output corresponding scan signals to corresponding pixels; a plurality of data lines, configured to receive a piece of display data and output corresponding pixel voltages to corresponding pixels, wherein the plurality of data lines comprises 12 successive data lines from left to right; a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, positive, negative, positive, negative, negative, positive, negative, positive, negative, and positive to the 12 data lines, and each column of pixels comprises a pixel in a first form and a pixel in a second form; when the display data has a same gray scale, the data driver respectively provides a first pixel voltage and a second pixel voltage to the first pixel in a first form and the second pixel in a second form, and the first pixel voltage is different from the second pixel voltage.

Another display device disclosed in the present invention comprises a plurality of gate lines, configured to output corresponding scan signals to corresponding pixels; a plurality of data lines, configured to receive a piece of display data and output corresponding pixel voltages to corresponding pixels, wherein the plurality of data lines comprises 12 successive data lines from left to right; a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, positive, negative, positive, negative, positive, negative, positive, negative, positive, negative, positive, and negative to the 12 data lines, and each column of pixels comprises a pixel in a first form and a pixel in a second form; when the display data has a same gray scale, the data driver respectively provides a first pixel voltage and a second pixel voltage to the first pixel in a first form and the second pixel in a second form, and the first pixel voltage is different from the second pixel voltage.

Another display device disclosed in the present invention comprises a plurality of gate lines, configured to output corresponding scan signals to corresponding pixels; a plurality of data lines, configured to receive a piece of display data and output corresponding pixel voltages to corresponding pixels, wherein the plurality of data lines comprises 8 successive data lines from left to right; a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, negative, positive, negative, positive, positive, and negative to the 8 data lines, and each column of pixels comprises a pixel in a first form and a pixel in a second form; when the display data has a same gray scale, the data driver respectively provides a first pixel voltage and a second pixel voltage to the first pixel in a first form and the second pixel in a second form, and the first pixel voltage is different from the second pixel voltage.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein:

FIG. 4 is a schematic diagram of pixel arrangement corresponding to step 310 of FIG. 3.

FIG. 5 is a schematic diagram of pixel arrangement corresponding to step 320 of FIG. 3.

FIGS. 11B, 14B, and 17B are schematic diagrams of pixel voltages corresponding to the embodiments of FIGS. 11A, 14A, and 17A.

FIGS. 20 to 29 are schematic diagrams of arrangement of a plurality of colors and a plurality of data lines included in a display panel in embodiments of the present invention.

DETAILED DESCRIPTION

The detailed features and advantages of the present invention are described below in great detail through the following implementation manners, and the content of the detailed description is sufficient for persons skilled in the art to understand the technical content of the present invention and to implement the present invention there accordingly. Based upon the content of the specification, the claims, and the drawings, persons skilled in the art can easily understand the relevant objectives and advantages of the present invention. The following embodiments further describe the viewpoints of the present invention in detail, but are not intended to limit the scope of the present invention in any way. The present invention is further described below with reference to the accompanying drawings of the specification.

Unless otherwise specified, terms (terms) used in the entire specification and the claims generally have common meanings used in the field, in the disclosed content and in special content.

Figure 1:
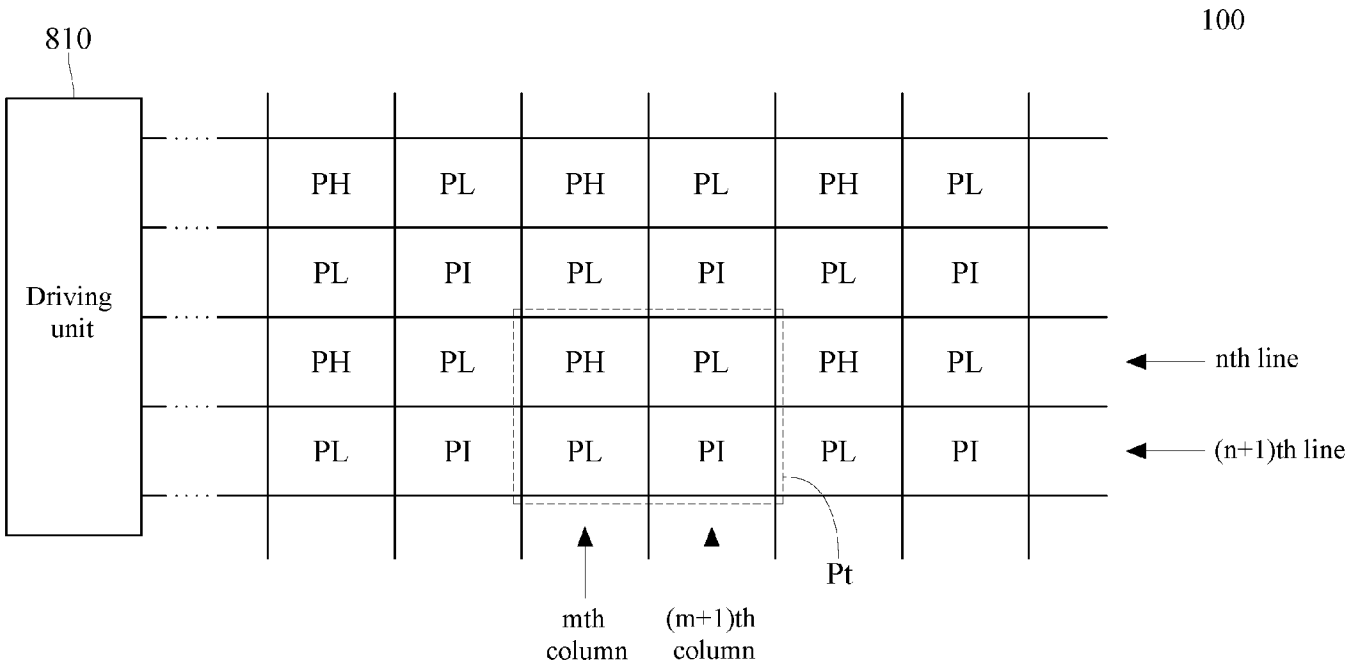
FIG. 1 is a schematic diagram of pixel arrangement of a display panel of an embodiment of the present invention.

FIG. 1 is a schematic diagram of pixel arrangement of a display panel 100 of an embodiment of the present invention. The display panel 100 may include a plurality of pixels, and each pixel may be configured to display a color. Pixels in FIG. 1 are all pixels that display a same color, and the pixels may include pixels PH, pixels PI, and pixels PL, and each pixel corresponds to one piece of display data to be displayed on the pixels. In other words, any two pixels correspond to different parts of the display data. A plurality of the pixels PH may form a first group of pixels; a plurality of the pixels PI may form a second group of pixels; and a plurality of the pixels PL may form a third group of pixels. Arrangement of the pixels PH, the pixels PI, and the pixels PL may be shown in FIG. 1. According to the embodiment of FIG. 1, in an nth line of the display panel 100, the plurality of the pixels PH of the first group of pixels and the plurality of the pixels PL of the third group of pixels may be arranged in a staggered way; in an (n+1)th line, the plurality of the pixels PI of the second group of pixels and the plurality of the pixels PL of the third group of pixels may be arranged in a staggered way; in an mth column, the plurality of the pixels PH and the plurality of the pixels PL may be arranged in a staggered way; in an (m+1)th column, the plurality of the pixels PI and the plurality of the pixels PL may be arranged in a staggered way; the foregoing nth line may be adjacent to the (n+1)th line, and the mth column may be adjacent to the (m+1)th column, where n and m may be both positive odd numbers or both positive even numbers. As shown in FIG. 1, the display panel 100 may further include a driving unit 810, which will be described below.

The pixels (PH, PI, and PL) shown in FIG. 1 are pixels that display a same color to facilitate describing a principle of this embodiment of the present invention. However, the display panel can actually display pixels of a plurality of colors, and this will be further described in embodiments of FIG. 9 to FIG. 12. Therefore, each of the foregoing pixels may be provided between two pixels of different colors, and the colors may be, for example, red, green, or blue. A pixel group Pt shown in FIG. 1 is exemplified by including four pixels that display a same color. The pixel panel 100 may include a plurality of pixel groups Pt.

Figure 2:
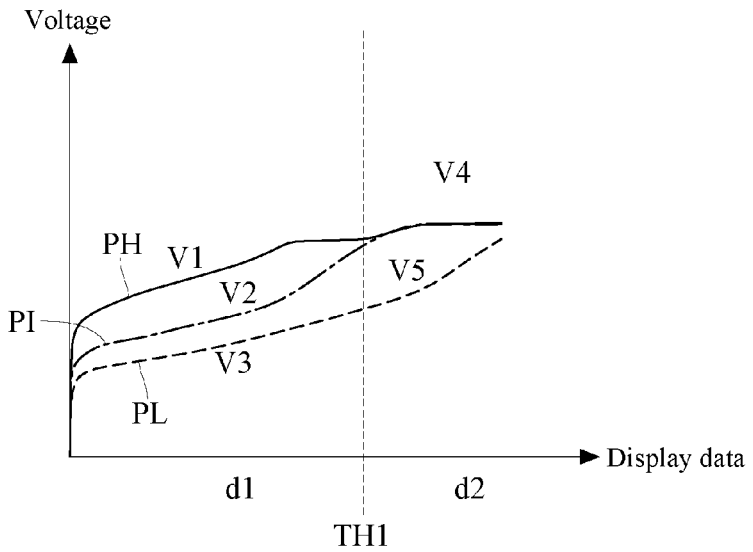
FIG. 2 is a curve diagram of display data to be displayed on pixels versus voltages applied to the pixels in an embodiment of the present invention.

FIG. 2 is a curve diagram of display data to be displayed on pixels versus voltages applied to the pixels in an embodiment of the present invention. In FIG. 2, display data on a horizontal axis may be gray scale values, or relevant values corresponding to gray scales; a vertical axis may represent values of voltages applied to pixels, root mean square (root mean square) values of voltage values, or normalized (normalized) voltage values, and a unit thereof may be volt. In FIG. 2, by using a threshold TH1 as a boundary, the display data on the horizontal axis may be divided into first data d1 less than the threshold TH1 and second data d2 greater than the threshold TH1. In other words, the first data d1 may correspond to a low gray scale value to be displayed on pixels, and the second data d2 may correspond to a high gray scale value to be displayed on the pixels. In FIG. 2, a first voltage V1, a second voltage V2, a third voltage V3, a fourth voltage V4, and a fifth voltage V5 may be voltage values, supplied to pixels of a display panel 100, of displayed data when the pixels of the display panel 100 display various data (for example, the first data d1, and the second data d2). The pixels of the display panel 100 can be grouped. In this embodiment of the present invention, a first group of pixels may include pixels PH; a second group of pixels may include pixels PI; and a third group of pixels may include pixels PL. A relationship between the pixels PH, PI, and PL, the display data (for example, d1 and d2), and the voltages supplied to the pixels (for example, the first voltage V1 to the fifth voltage V5) may be shown in FIG. 2, and refer to FIG. 3 for relevant operation steps.

Figure 3:
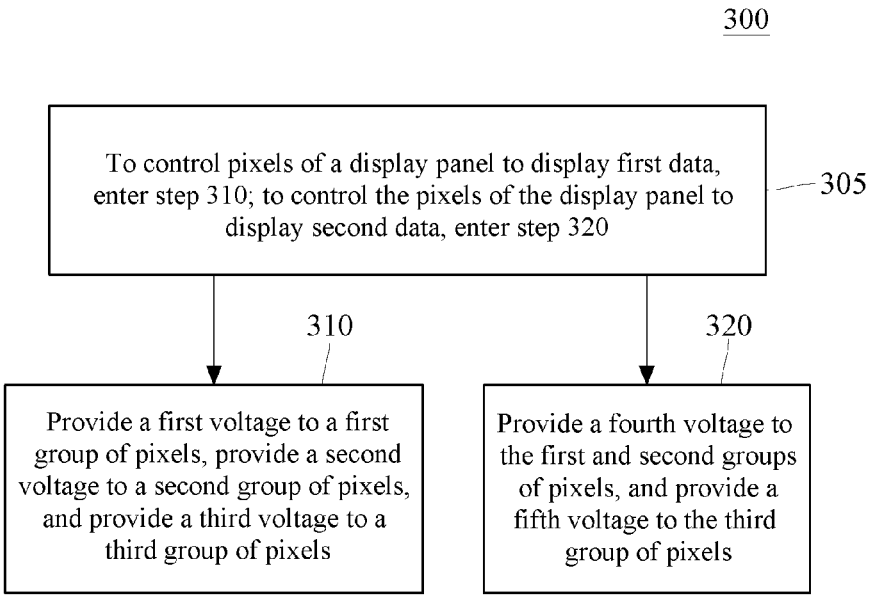
FIG. 3 is a flowchart of a driving method for a display panel of an embodiment of the present invention.

FIG. 3 is a flowchart of a driving method 300 for a display panel of an embodiment of the present invention. Referring to FIG. 1 and FIG. 2, the driving method 300 may include:

step 305: to control pixels of a display panel 100 to display first data d1, entering step 310; to control the pixels of the display panel 100 to display second data d2, entering step 320;

step 310: providing a first voltage V1 to a first group of pixels, providing a second voltage V2 to a second group of pixels, and providing a third voltage V3 to a third group of pixels; and step 320: providing a fourth voltage V4 to the first and second groups of pixels, and providing a fifth voltage V5 to the third group of pixels, where the first voltage V1 may be greater than the second voltage V2; the first voltage V1 may be greater than the third voltage V3; the second voltage V2 may be greater than or equal to the third voltage V3; and the fourth voltage V4 may be greater than the fifth voltage V5.

According to this embodiment of the present invention, in pixel groups included in the display panel 100, a relationship between a gray scale and brightness displayed thereby of pixels PH included in the first group of pixels may be determined according to a first gamma function; a relationship between a gray scale and brightness displayed thereby of pixels PI included in the second group of pixels may be determined according to a second gamma function; and a relationship between a gray scale and brightness displayed thereby of pixels PL included in the third group of pixels may be determined according to a third gamma function. The foregoing first voltage V1 to the fifth voltage V5 may respectively correspond to a first brightness to a fifth brightness, where the first brightness may be greater than the second brightness and the third brightness; the fourth brightness may be greater than the fifth brightness; and the second brightness may be greater than or equal to the third brightness.

The display panel 100 may include the driving unit 810, which can be electrically coupled to the first, second, and third groups of pixels, and are configured to determine, according to the first gamma function, the relationship between a gray scale and brightness displayed by the first group of pixels, determine, according to the second gamma function, the relationship between a gray scale and brightness displayed by the second group of pixels, and determine, according to the third gamma function, the relationship between a gray scale and brightness displayed by the third group of pixels. The driving unit 810, for example, may be a timing control source driver (Tcon source driver), an application specific integrated circuit (ASIC), or the like.

FIG. 4 is a schematic diagram of pixel arrangement corresponding to step 310 of FIG. 3. FIG. 4 is an example that a ratio between total areas of the first groups of pixels, the second groups of pixels, and the third groups of pixels is substantively about 1:1:2. In detail, if areas of each first group of pixels, each second group of pixels, and each third group of pixels are approximately the same, then a ratio between quantities of the first groups of pixels, the second groups of pixels, and the third groups of pixels is also about 1:1:2, and therefore a ratio between quantities of VH, VI, and VL corresponding to the pixels in the pixel group Pt is substantively about 1:1:2. In addition, adjustment of the ratio between the total areas may also be implemented by means of adjustment of quantities of the first groups of pixels, the second groups of pixels, and the third groups of pixels and/or by means of adjustment of individual areas. As shown in FIG. 4, a ratio between areas occupied by the pixels PH applied with a high voltage (for example, the first voltage V1) and the pixels PI and PL applied with low voltages (for example, the second voltage V2 and the third voltage V3) when the first data d1 (for example, data with a low gray scale) is displayed may be shown in a math formula eq-1:

$$(\text{area occupied by the pixels } PH):(\text{area occupied by the pixels } PI + \text{area occupied by the pixels } PL) = 1:3 \quad \text{(eq-1)}.$$

If pixels applied with a high voltage are considered as a main part, and parts applied with low voltages are considered as a secondary part, then when a ratio between areas of the main part and the secondary part ranges between 2:8 (that is, 1:4) and 3:7 (that is, about 1:2.3), a lowest tone render distortion index (tone render distortion index; called a TRDI value below) can be obtained. Refer to Table 1 and teaching of K.-C.Tien et al., IDW, 2012 for details:

TABLE 1

| Ratio between areas (Area of the main part:area of the secondary part) | Tone render distortion index (TRDI value) | Notes |
|---|---|---|
| 2:8 | 0.226 | In this embodiment of the present invention, when the first data d1 is displayed, the ratio between areas of the main part and the secondary part may be 1:3, which can make the TRDI value low, so as to improve a color washout problem. |
| 3:7 | 0.223 | |
| 4:6 | 0.236 | The TRDI value is high, and the color washout problem is obvious. |
| 5:5 | 0.254 | The TRDI value is high, and the color washout problem is obvious. |

Because a low TRDI value may correspond to a slight color washout phenomenon, a visual effect of side view of a large viewing angle is close to that of a front viewing angle. Because the color washout phenomenon is obvious when data with a low gray scale is displayed (for example, the first data d1 is displayed), in the driving manner shown in step 310 and FIG. 4, adjusting supplied voltages to enable the ratio between areas of the main part and the secondary part to be substantively 1:3 can effectively improve the color washout phenomenon of a side viewing angle when the data with a low gray scale is displayed.

When data with a high gray scale is displayed, if the ratio between areas of pixels is also show in FIG. 4 to make the ratio between areas of the main part and the secondary part small, then a checker pattern problem is obvious. Therefore, step 320 may be executed to improve the diamond pattern problem.

FIG. 5 is a schematic diagram of pixel arrangement corresponding to step 320 of FIG. 3. A ratio between areas of the pixels PH and PI applied with a high voltage (for example, the fourth voltage V4) and the pixels PL applied with a low voltage (for example, the fifth voltage V5) when the second data d2 (for example, data with a high gray scale) is displayed may be shown in a math formula eq-2:

$$(\text{area occupied by the pixels } PH + \text{area occupied by the pixels } PI):(\text{area occupied by the pixels } PL) = 1:1 \quad \text{(eq-2)}.$$

Therefore, if pixels applied with a high voltage are considered as a main part, and parts applied with a low voltage are considered as a secondary part, then step 320 may enable a ratio between areas of pixels of the main part and the secondary part to be 1:1. Generally, when a high gray scale is displayed (that is, brightness is high), the diamond pattern problem is obvious visually. According to experience, when the ratio between areas of pixels of the main part and the secondary part is substantively 1:1, arrangement of the main part and the secondary part can be compact, so that the diamond pattern problem can be effectively improved. Therefore, when data with a high gray scale is displayed, the diamond pattern problem can be improved by means of step 320 and the pixel arrangement manner of FIG. 5.

In this embodiment of the present invention, the total area of the first groups of pixels (formed by the pixels PH) may be substantively less than or equal to a sum of the total area of the second groups of pixels (formed by the pixels PI) and the total area of the third groups of pixels (formed by the pixels PL), so as to improve the color washout problem of a side viewing angle, and reduce the diamond pattern and color breaking problems. According to an embodiment of the present invention, the ratio between the total areas of the first groups of pixels, the second groups of pixels, and the third groups of pixels may be substantively 1:1:2, so as to achieve an optimal display effect.

Figure 6:
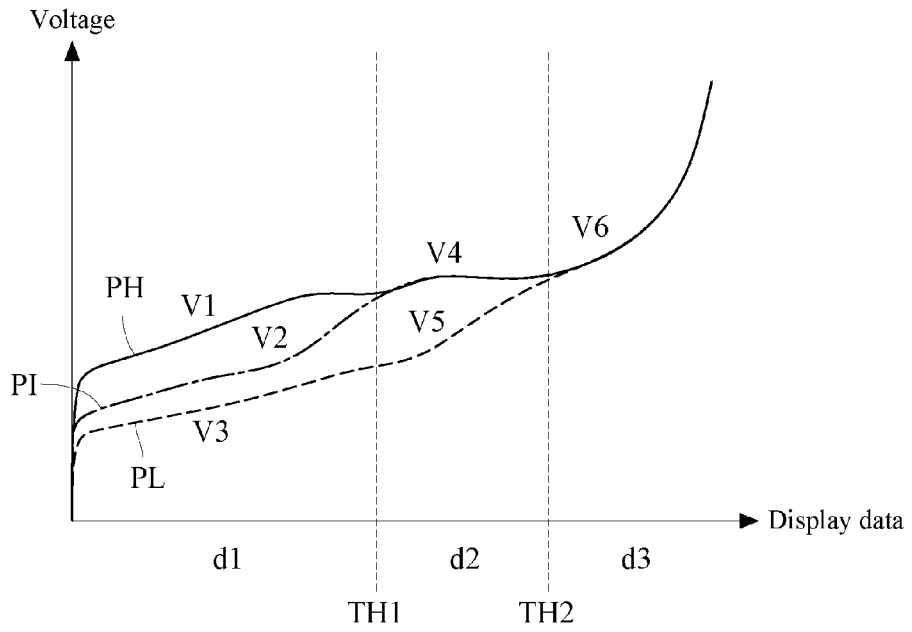
FIG. 6 is a curve diagram of display data to be displayed on pixels versus voltages applied to the pixels in another embodiment of the present invention.

FIG. 6 is a curve diagram of display data to be displayed on pixels versus voltages applied to the pixels in another embodiment of the present invention. In the embodiment of FIG. 6, when first data d1 and second data d2 are displayed, operation, that is, a curve thereof may be stated in the embodiment of FIG. 2 to FIG. 5; when third data d3 is displayed, a sixth voltage V6 may be provided to a first group of pixels (formed by pixels PH), a second group of pixels (formed by pixels PI), and a third group of pixels (formed by pixels PL). The third data d3 may be greater than a threshold TH2, and the second data d2 may be less than the threshold TH2. This can reduce the complexity of operating voltages, and still can improve the foregoing diamond pattern problem, the color breaking problem, and the color washout problem of the side viewing angle.

Figure 7:
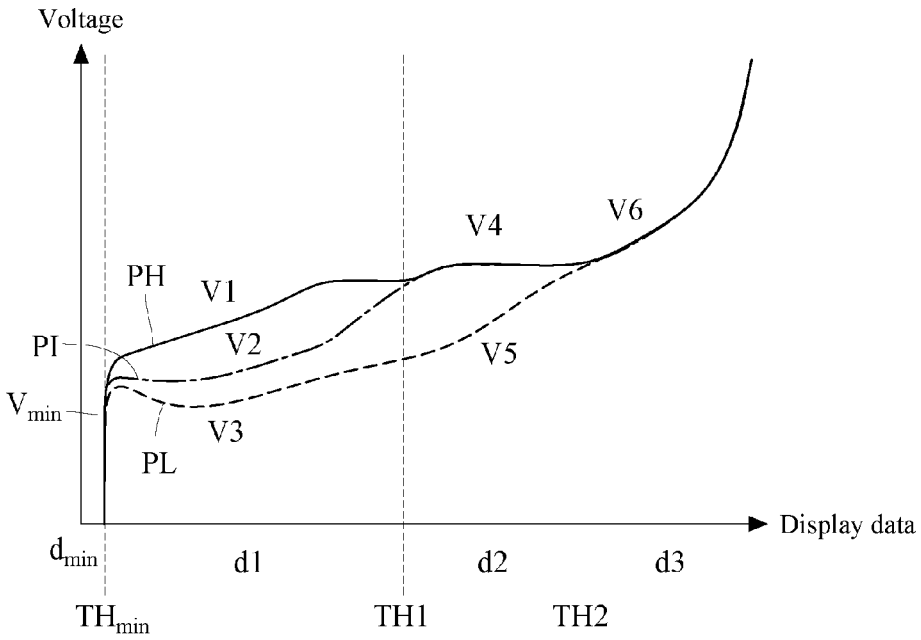
FIG. 7 is a curve diagram of display data to be displayed on pixels versus voltages applied to the pixels in another embodiment of the present invention.

FIG. 7 is a curve diagram of display data to be displayed on pixels versus voltages applied to the pixels in another embodiment of the present invention. In the embodiment of FIG. 6, when the first data d1, the second data d2, and the third data d3 are displayed, the operation, that is, the curve thereof may be stated in the embodiment of FIG. 6. When fourth data dmin is displayed, a same voltage Vmin may be provided to a first group of pixels, a second group of pixels, and a third group of pixels. The fourth data dmin may be less than a threshold THmin, and first data d1 may be greater than the threshold THmin. For example, to enable the first group of pixels (formed by the pixels PH), the second group of pixels (formed by the pixels PI), and the third group of pixels (formed by the pixels PL) to display an ultralow gray scale image close to black, the voltage Vmin may be provided to all the three groups of pixels. This can facilitate voltage setting, and can also simplify test flows, for example, a test flow of image sticking (image sticking).

Figure 8:
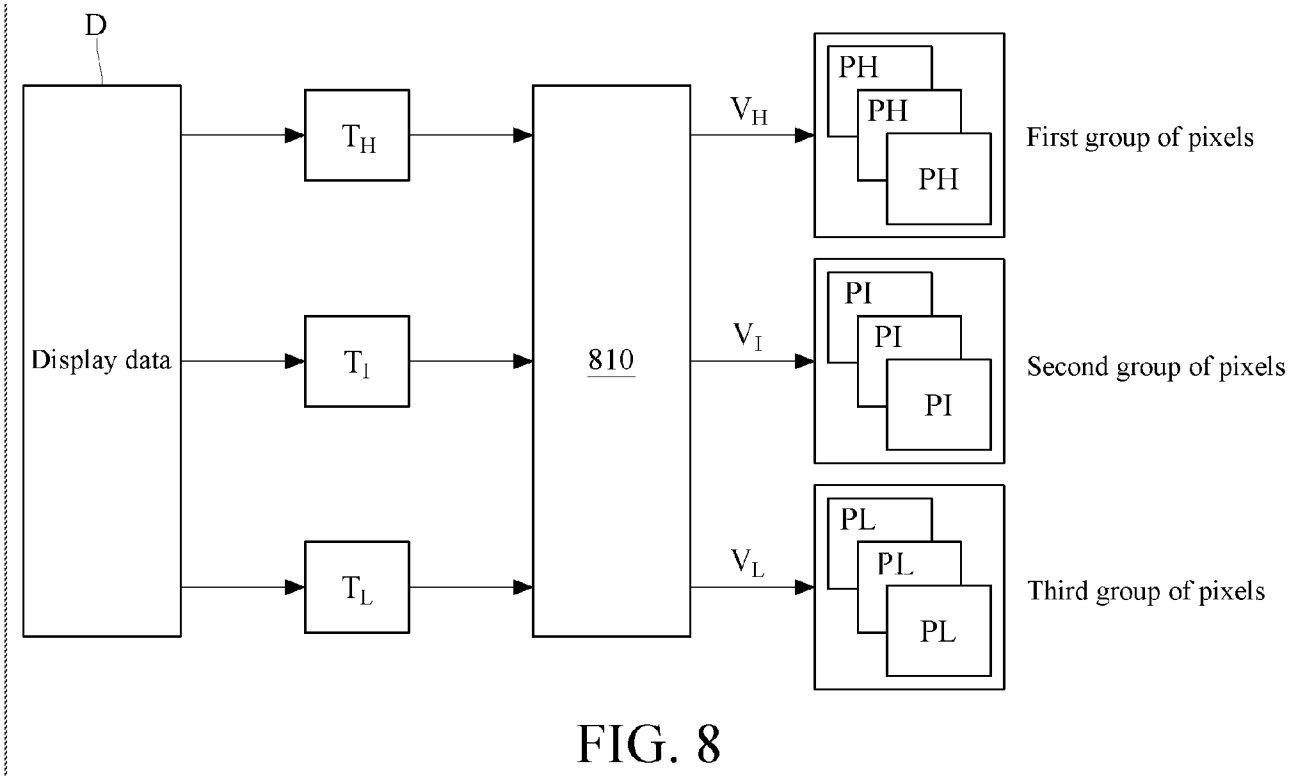
FIG. 8 is a schematic diagram of control of a display panel of an embodiment of the present invention.

FIG. 8 is a schematic diagram of control of a display panel of an embodiment of the present invention. To display display data D on a display panel 100, the display data D may be input into query tables TH, TI, and TL. As stated above, the display data D may be a gray scale value, or a relevant value corresponding to a gray scale. The query tables TH, TI, and TL may be provided in a control IC or a programmable access device of the display panel 100, and respectively correspond to the first group of pixels, the second group of pixels, and the third group of pixels. After table query, a driving unit 810 may control a voltage supply unit to respectively provide voltages VH, VI, and VL corresponding to the display data D to the first group of pixels, the second group of pixels, and the third group of pixels, so as to provide voltages according to the curve diagram shown in FIG. 2, FIG. 6, or FIG. 7. In addition, the query tables TH, TI, and TL may also be integrated in the driving unit.

Figure 9:
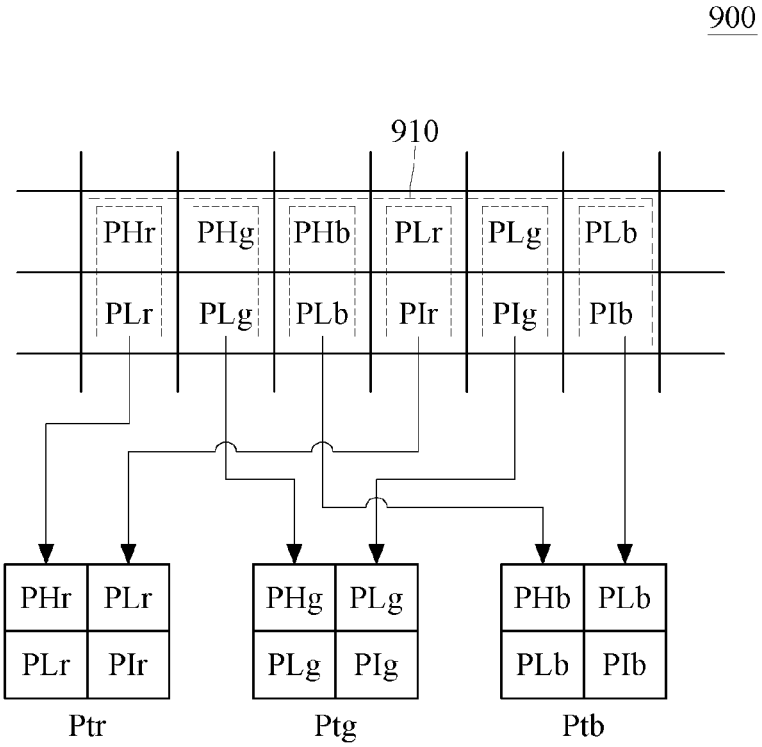
FIGS. 9, 10, 11A, 12, 14A, 15, 16, 17A, 18, and 19 are schematic diagrams of a display panel including pixels of a plurality of colors in embodiments of the present invention.

FIG. 9 is a schematic diagram of a display panel 900 including pixels of a plurality of colors in an embodiment of the present invention. As described in the description of the foregoing FIG. 1, the pixel Pt of FIG. 1 and the pixel arrangements of FIG. 4 and FIG. 5 are exemplified by pixels that display a same color, so as to facilitate describing principles of the embodiments of the present invention. When a display panel includes a plurality of colors, pixel arrangement thereof may be shown in FIG. 9. In FIG. 9, pixels PHr, PHg, and PHb may correspond to the foregoing pixels PH; pixels PIr, PIg, and PIb may correspond to the foregoing pixels PI; and pixels PLr, PLg, and PLb may correspond to the foregoing pixels PL. The foregoing r, g, and b are separately used to mark colors of pixels. The pixels PHr, PIr, and PLr may be used to display red and form another pixel group; the pixels PHg, PIg, and PLg may be used to display green and form another pixel group; and the pixels PHb, PIb, and PLb may be used to display blue and form another pixel group. By using a pixel arrangement manner 910 as an example, if pixels that display red are captured, a pixel group Ptr can be formed, and the pixel group Ptr may correspond to the foregoing pixel group Pt; similarly, a pixel group Ptg (formed by pixels that display green) and a pixel group Ptb (formed by pixels that display blue) may separately correspond to the pixel group Pt. In this way, the driving method for the display panel in the embodiments of FIG. 1 to FIG. 8 of the present invention can be implemented, so that the display panel displays a plurality of colors, for example, red, green, and blue, thereby implementing color display.

Figure 10:
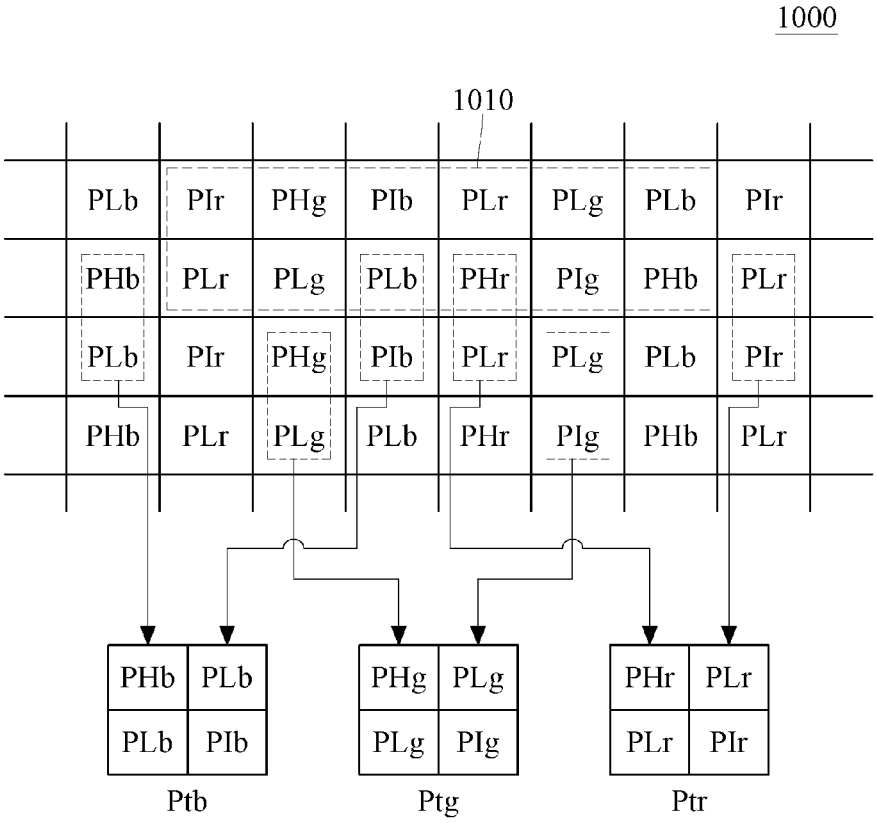
Figure 11A:
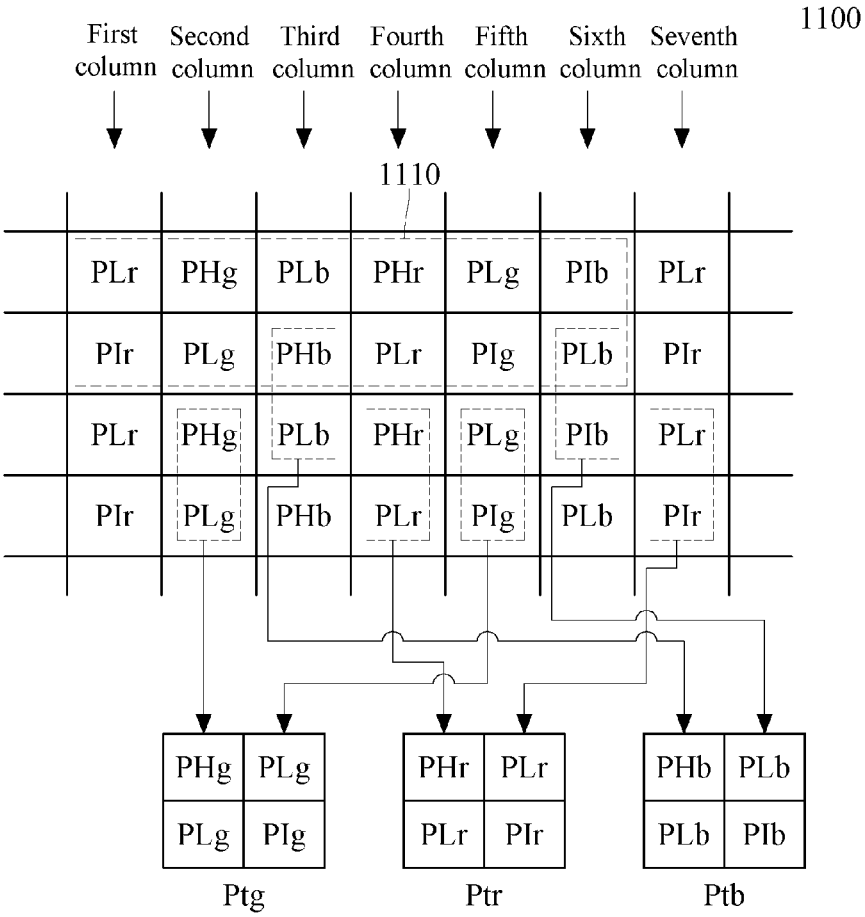
Figure 11B:
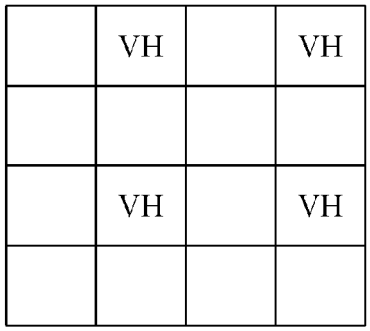
Figure 12:
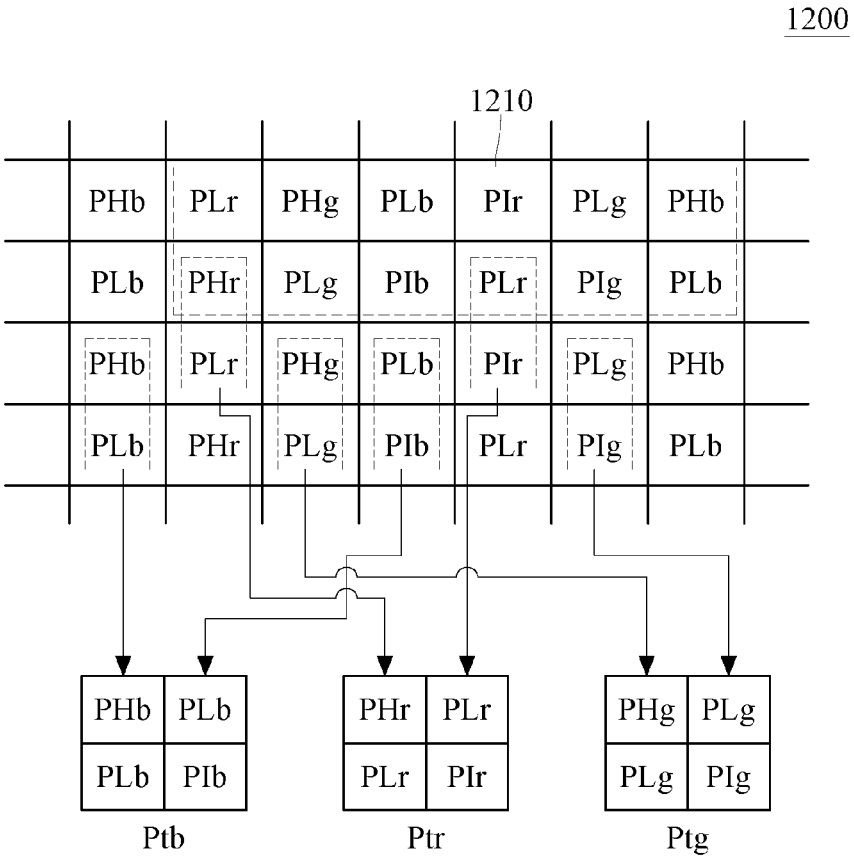

In addition to the pixel arrangement manner 910 of FIG. 9, embodiments of the present invention may also allow other pixel arrangement manners. FIG. 10 to FIG. 12 are respectively schematic diagrams of display panels 1000 to 1200 including pixels of a plurality of colors in embodiments of the present invention. As shown in FIG. 10 to FIG. 12, pixels may be repeatedly arranged in pixel arrangement manners 1010, 1110, and 1210 respectively. The pixel arrangement manners 1010, 1110, and 1210 all can enable pixels that display red, green, and blue to be arranged in manners of pixel groups Ptr, Ptg, and Ptb respectively, so as to implement the driving method of the display panel of the embodiments of FIG. 1 to FIG. 8 of the present invention, so that a plurality of colors is mixed to display colors, and at the same time, improve an image color washout problem, a diamond pattern problem, and a color breaking problem. According to experience, color distribution of the pixel arrangement manner 1110 of FIG. 11A may be uniform. As shown in FIG. 11A, the pixel arrangement manner 1110 may include 12 pixels; pixels PLr, PHg, PLb, PHr, PLg, and PIb are located on a first line from left to right respectively; and pixels PIr, PLg, PHb, PLr, PIg, and PLb are located on a second line from left to right respectively; PH, PL, and PI are respectively used to mark gamma functions upon which pixels are driven; r, g, and b are used to mark colors of the pixels. All pixels of the display panel 1100 of FIG. 11A may be repeatedly arranged in the pixel arrangement manner 1110, so as to achieve a good effect of improving an image color washout problem, a diamond pattern problem, and a color breaking problem. As shown in FIG. 10, the pixel arrangement manner 1010 may include 12 pixels; pixels PIr, PHg, PIb, PLr, PLg, and PLb are located on a first line from left to right respectively; and pixels PLr, PLg, PLb, PHr, PIg, and PHb are located on a second line from left to right respectively; PH, PL, and PI are respectively used to mark gamma functions upon which pixels are driven; r, g, and b are used to mark colors of the pixels. The pixel arrangement manner 1210 may include 12 pixels; pixels PLr, PHg, PLb, PIr, PLg, and PHb are located on a first line from left to right respectively; and pixels PHr, PLg, PIb, PLr, PIg, and PLb are located on a second line from left to right respectively; PH, PL, and PI are respectively used to mark gamma functions upon which pixels are driven; r, g, and b are used to mark colors of the pixels.

According to any one of FIG. 9 to FIG. 12, a same pixel group Pt may be used to display a color (for example, red, green, or blue), and one pixel in the pixel group may be provided between two pixels of different colors, and adjacent to the two pixels, for example, a pixel that displays red may be located between a pixel that displays blue and a pixel that displays green. FIG. 9 to FIG. 12 describe a pixel color mixing principle by using red, green, and blue as an example. However, embodiments of the present invention are not limited to use of red, green, and blue, and may also use other technically allowed colors displayed by pixels for color mixing.

Figure 13:
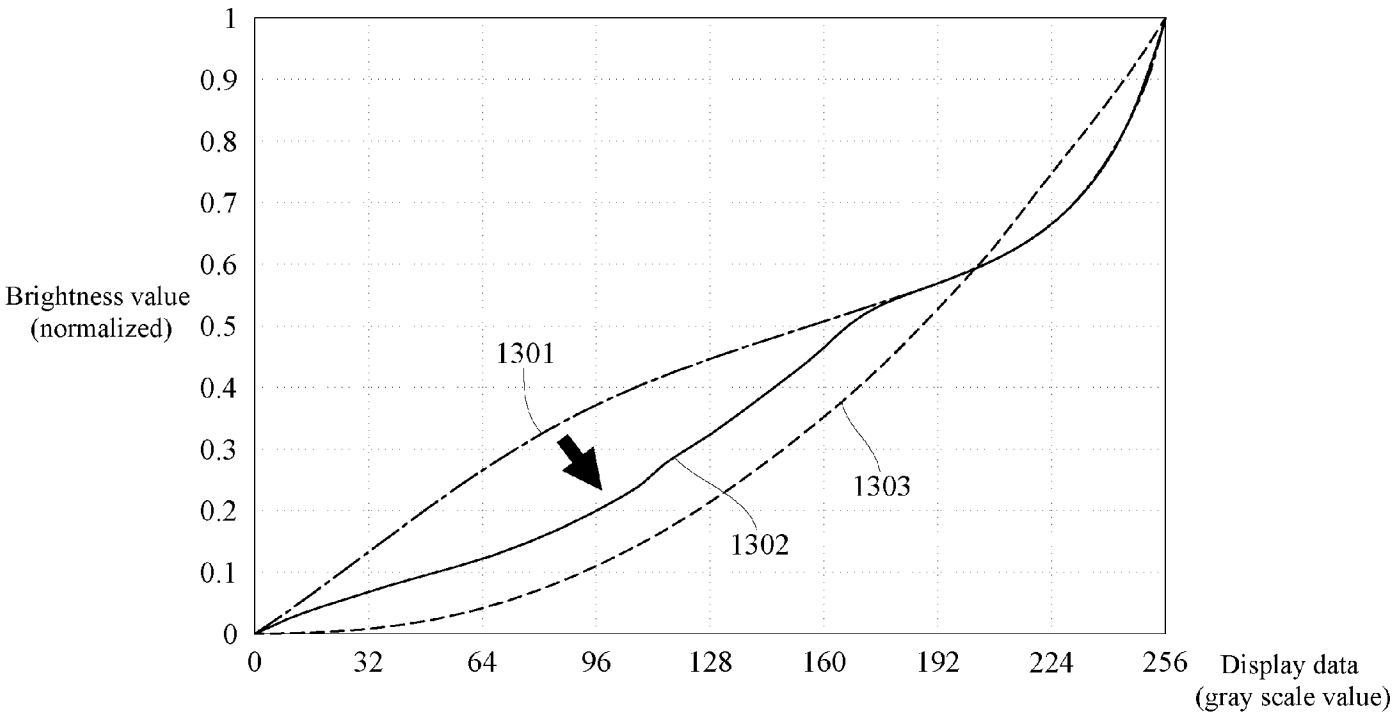
FIG. 13 is a schematic diagram of gamma curves of a side viewing angle of an embodiment of the present invention.

FIG. 13 is a schematic diagram of gamma curves of a side viewing angle of an embodiment of the present invention. A horizontal axis of FIG. 13 may represent the foregoing display data, and scale values are used as an example herein; a vertical axis may represent brightness values, and the brightness values may be normalized between 0 and 1 to facilitate comparison. A curve 1303 may a Gamma 2.2 (Gamma 2.2) curve corresponding to standards of sRGB (standard RGB). Curves 1301 and 1302 may be gamma curves of a 60-degree right side viewing angle. The curve 1301 may be a gamma curve, which is not used, of this embodiment of the present invention, and deviates from the curve 1303 to a great extent in an interval, for example, between 32 and 160, of the gray scales, and therefore a color washout problem easily occurs. By using a display panel and a driving method of this embodiment of the present invention, a gamma curve may be adjusted from the curve 1301 to the curve 1302, and therefore is close to the Gamma 2.2 (Gamma 2.2) curve, so as to improve a display effect.

Further referring to the embodiment of FIG. 11A, the display panel 1100 is expanded in an array in the pixel arrangement manner 1110; therefore, red pixels corresponding to a first column are sequentially PLr, PIr, PLr, and PIr from up to down; red pixels corresponding to a fourth column are sequentially PHr, PLr, PHr, and PLr from up to down; red pixels corresponding to a seventh column are sequentially PLr, PIr, PLr, and PIr from up to down; and red pixels corresponding to a tenth column are sequentially PHr, PLr, PHr, and PLr (not shown in the drawing) from up to down. On the other aspect, when an image displays a red image, further refer to FIG. 11B. Because a plurality of red pixel voltages VL corresponding to the PLr presents distribution in a regular grid form, a grid pattern defect occurs to human eyes visually, and consequently, an image presentation effect is poor. To improve the grid pattern defect, further refer to the following embodiments of FIG. 14 to FIG. 19.

Figure 14A:
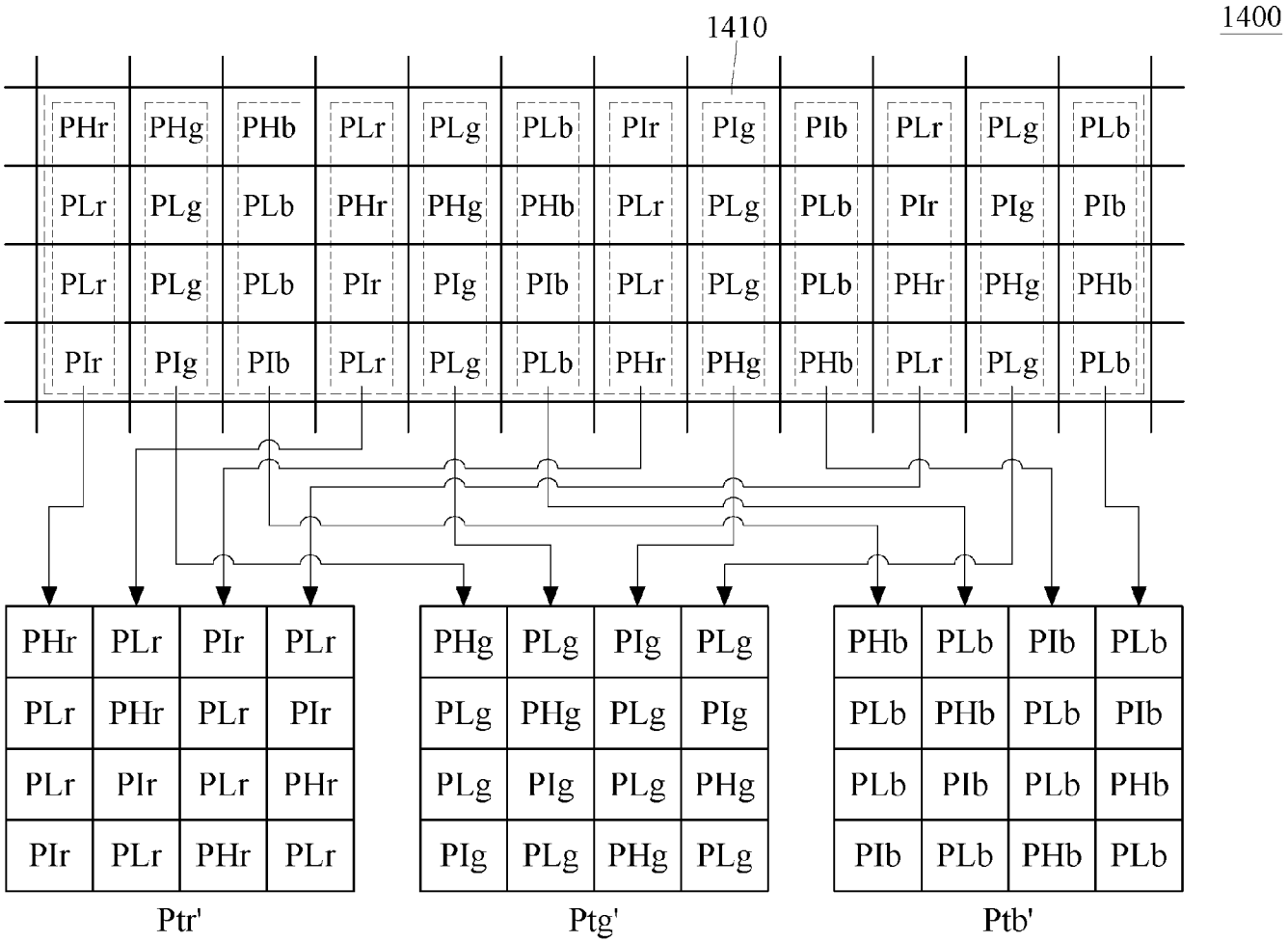

FIG. 14A is a schematic diagram of a display panel 1400 according to an embodiment of the present invention. As shown in FIG. 14A, a pixel arrangement manner 1410 may include 48 pixels; pixels PHr, PHg, PHb, PLr, PLg, PLb, PIr, PIg, PIb, PLr, PLg, and PLb are located on a first line from left to right respectively; pixels PLr, PLg, PLb, PHr, PHg, PHb, PLr, PLg, PLb, PIr, PIg, and PIb are located on a second line from left to right respectively; pixels PLr, PLg, PLb, PIr, PIg, PIb, PLr, PLg, PLb, PHr, PHg, and PHb are located on third line from left to right respectively; and pixels PIr, PIg, PIb, PLr, PLg, PLb, PHr, PHg, PHb, PLr, PLg, and PLb are located on a fourth line from left to right respectively. PH, PL, and PI are respectively used to mark gamma functions upon which pixels are driven; r, g, and b are used to mark colors of the pixels. By using the pixel arrangement manner 1410 as an example, pixels of a same color may correspond to a pixel group Pt'; the pixel group Pt' differs from the pixel group Pt in that the pixel group Pt' is formed by 16 pixels. However, a ratio between quantities of VH, VL, and VI corresponding to the pixels is still substantively about 1:1:2. For example, if pixels that display red are captured, a pixel group Ptr' can be formed. Referring to FIG. 14A, pixels in a first line of the pixel group Ptr' are PHr, PLr, PIr, and PLr from left to right; pixels in a second line are PLr, PHr, PLr, and PIr from left to right; pixels in a third line are PLr, PIr, PLr, and PHr from left to right; and pixels in a fourth line are PIr, PLr, PHr, and PLr from left to right. In other words, pixel voltages in the first line of the pixel group Ptr' are VH, VL, VI, and VL from left to right; pixel voltages in the second line are VL, VH, VL, and VI from left to right; pixel voltages in the third line are VL, VI, VL, and VH from left to right; and pixel voltages in the fourth line are VI, VL, VH, and VL from left to right. Pixel voltage distribution in the pixel group Ptr' is defined as Vt' herein. By means of the arrangement design, further referring to FIG. 14B, FIG. 14B shows VH voltage distribution in the pixel group Pt'. Because the pixel voltages VH corresponding to pixels of a same color do not present regular grids as in the embodiment of FIG. 11B, the grid phenomenon of the embodiment of FIG. 11A can be effectively improved. Similarly, a pixel group Ptg' (formed by pixels that display green) and a pixel group Ptb' (formed by pixels that display blue) also separately correspond to same pixel voltage distribution Vt'.

Figure 15:
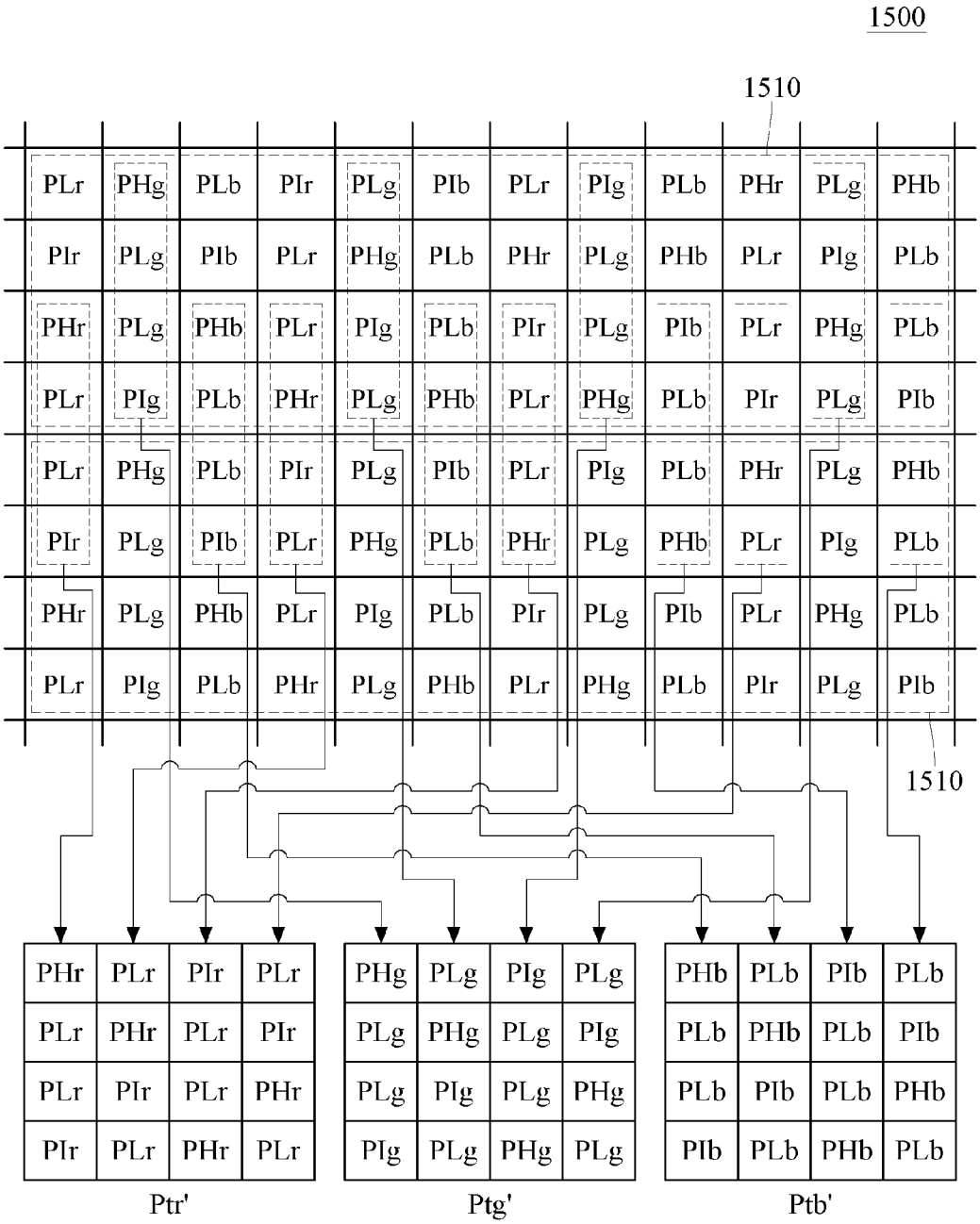
Figure 16:
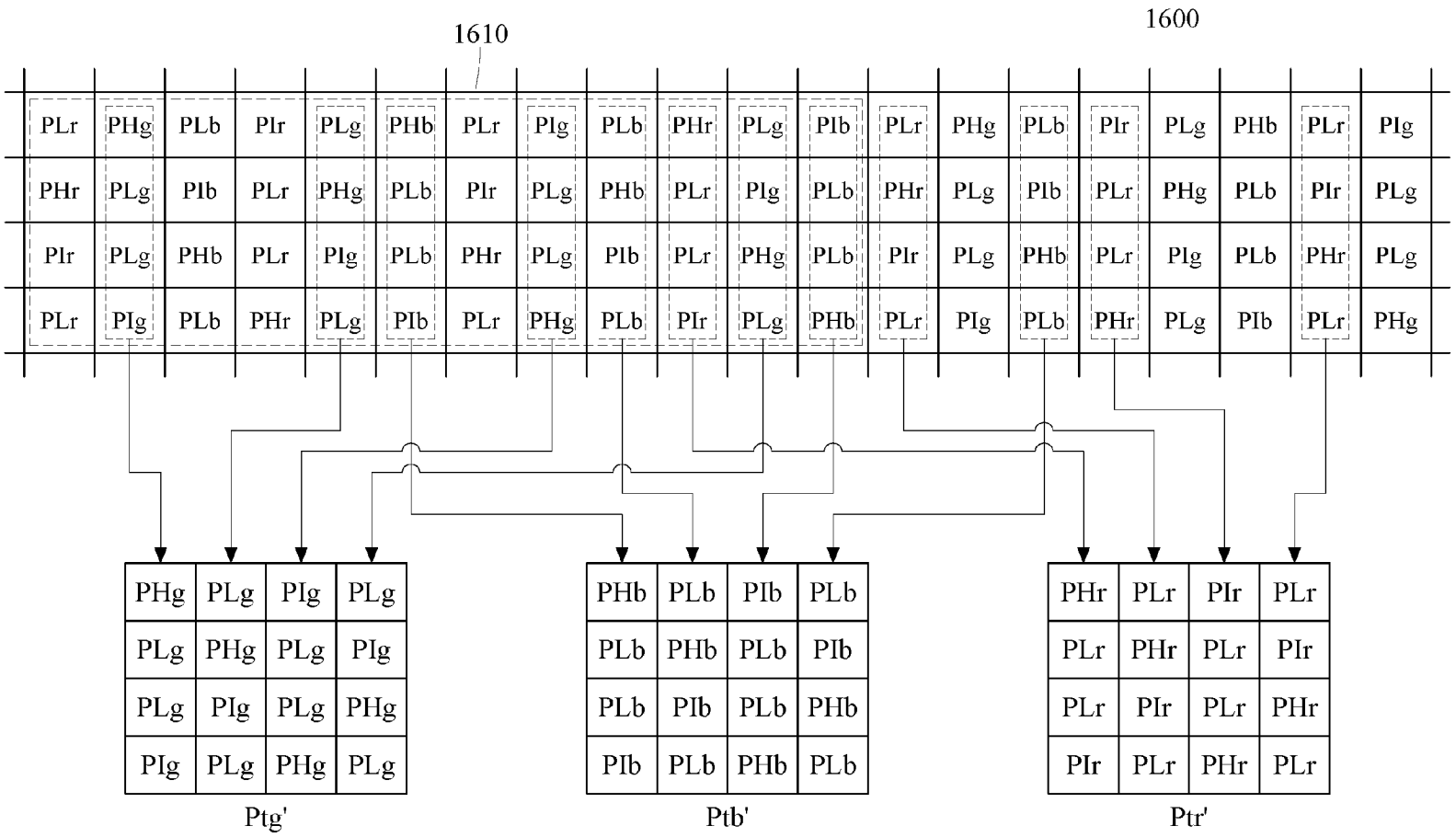

FIG. 15 and FIG. 16 are schematic diagrams of a display panel 1500 and a display panel 1600 according to another two embodiments of the present invention. As shown in FIG. 15, a pixel arrangement manner 1510 may include 48 pixels; pixels PLr, PHg, PLb, PIr, PLg, PIb, PLr, PIg, PLb, PHr, PLg, and PHb are located on a first line from left to right respectively; pixels PIr, PLg, PIb, PLr, PHg, PLb, PHr, PLg, PHb, PLr, PIg, and PLb are located on a second line from left to right respectively; pixels PHr, PLg, PHb, PLr, PIg, PLb, PIr, PLg, PIb, PLr, PHg, and PLb are located on third line from left to right respectively; and pixels PLr, PIg, PLb, PHr, PLg, PHb, PLr, PHg, PLb, PIr, PLg, and PIb are located on a fourth line from left to right respectively. PH, PL, and PI are respectively used to mark gamma functions upon which pixels are driven; r, g, and b are used to mark colors of the pixels. As shown in FIG. 16, a pixel arrangement manner 1610 may include 48 pixels; pixels PLr, PHg, PLb, PIr, PLg, PHb, PLr, PIg, PLb, PHr, PLg, and PIb are located on a first line from left to right respectively; pixels PHr, PLg, PIb, PLr, PHg, PLb, PIr, PLg, PHb, PLr, PIg, and PLb are located on a second line from left to right respectively; pixels PIr, PLg, PHb, PLr, PIg, PLb, PHr, PLg, PIb, PLr, PHg, and PLb are located on third line from left to right respectively; and pixels PLr, PIg, PLb, PHr, PLg, PIb, PLr, PHg, PLb, PIr, PLg, and PHb are located on a fourth line from left to right respectively. PH, PL, and PI are respectively used to mark gamma functions upon which pixels are driven; r, g, and b are used to mark colors of the pixels. The pixel arrangement manners 1510 and 1610 both can enable pixels that display red, green, and blue to be arranged in manners of pixel groups Ptr', Ptg', and Ptb' respectively. The pixel groups Ptr', Ptg', and Ptb' separately correspond to same pixel voltage distribution Vt'. By means of adjusting a relative location of a pixel voltage VL corresponding to pixels of a same color, a grid phenomenon can be improved.

Figure 17A:
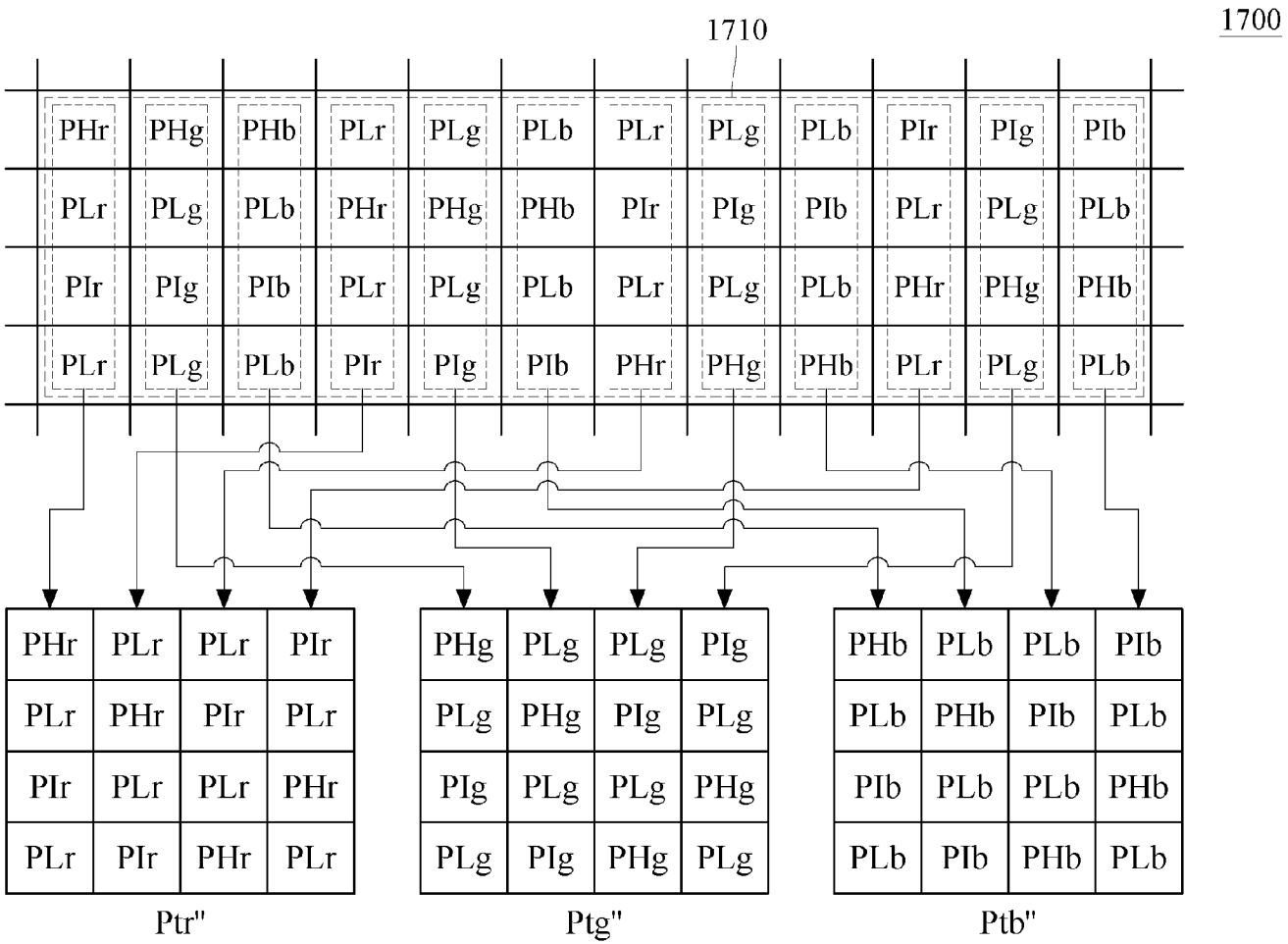

FIG. 17A is a schematic diagram of a display panel 1700 according to an embodiment of the present invention. As shown in FIG. 17A, a pixel arrangement manner 1710 may include 48 pixels; pixels PHr, PHg, PHb, PLr, PLg, PLb, PLr, PLg, PLb, PIr, PIg, and PIb are located on a first line from left to right respectively; pixels PLr, PLg, PLb, PHr, PHg, PHb, PIr, PIg, PIb, PLr, PLg, and PLb are located on a second line from left to right respectively; pixels PIr, PIg, PIb, PLr, PLg, PLb, PLr, PLg, PLb, PHr, PHg, and PHb are located on third line from left to right respectively; and pixels PLr, PLg, PLb, PIr, PIg, PIb, PHr, PHg, PHb, PLr, PLg, and PL are located on a fourth line from left to right respectively. PH, PL, and PI are respectively used to mark gamma functions upon which pixels are driven; r, g, and b are used to mark colors of the pixels. By using the pixel arrangement manner 1710 as an example, pixels of a same color may correspond to a pixel group Pt", but a ratio between quantities of VH, VL, and VI corresponding to the pixels is still substantively 1:1:2. For example, if pixels that display red are captured, a pixel group Ptr" can be formed. Referring to FIG. 17A, pixels in a first line of the pixel group Ptr" are PHr, PLr, PLr, and PIr from left to right; pixels in a second line are PLr, PHr, PIr, and PLr from left to right; pixels in a third line are PIr, PLr, PLr, and PHr from left to right; and pixels in a fourth line are PLr, PIr, PHr, and PLr from left to right. In other words, pixel voltages in the first line of the pixel group Ptr" are VH, VL, VL, and VI from left to right; pixel voltages in the second line are VL, VH, VI, and VL from left to right; pixel voltages in the third line are VI, VL, VL, and VH from left to right; and pixel voltages in the fourth line are VL, VI, VH, and VL from left to right. Pixel voltage distribution in the pixel group Ptr" is defined as Vt" herein. By means of the arrangement design, further referring to FIG. 17B, because the pixel voltages VH corresponding to pixels of a same color do not present regular grids as in the embodiment of FIG. 11B, the grid phenomenon of the embodiment of FIG. 11A can be effectively improved. Similarly, a pixel group Ptg" (formed by pixels that display green) and a pixel group Ptb" (formed by pixels that display blue) also separately correspond to same pixel voltage distribution Vt".

Figure 18:
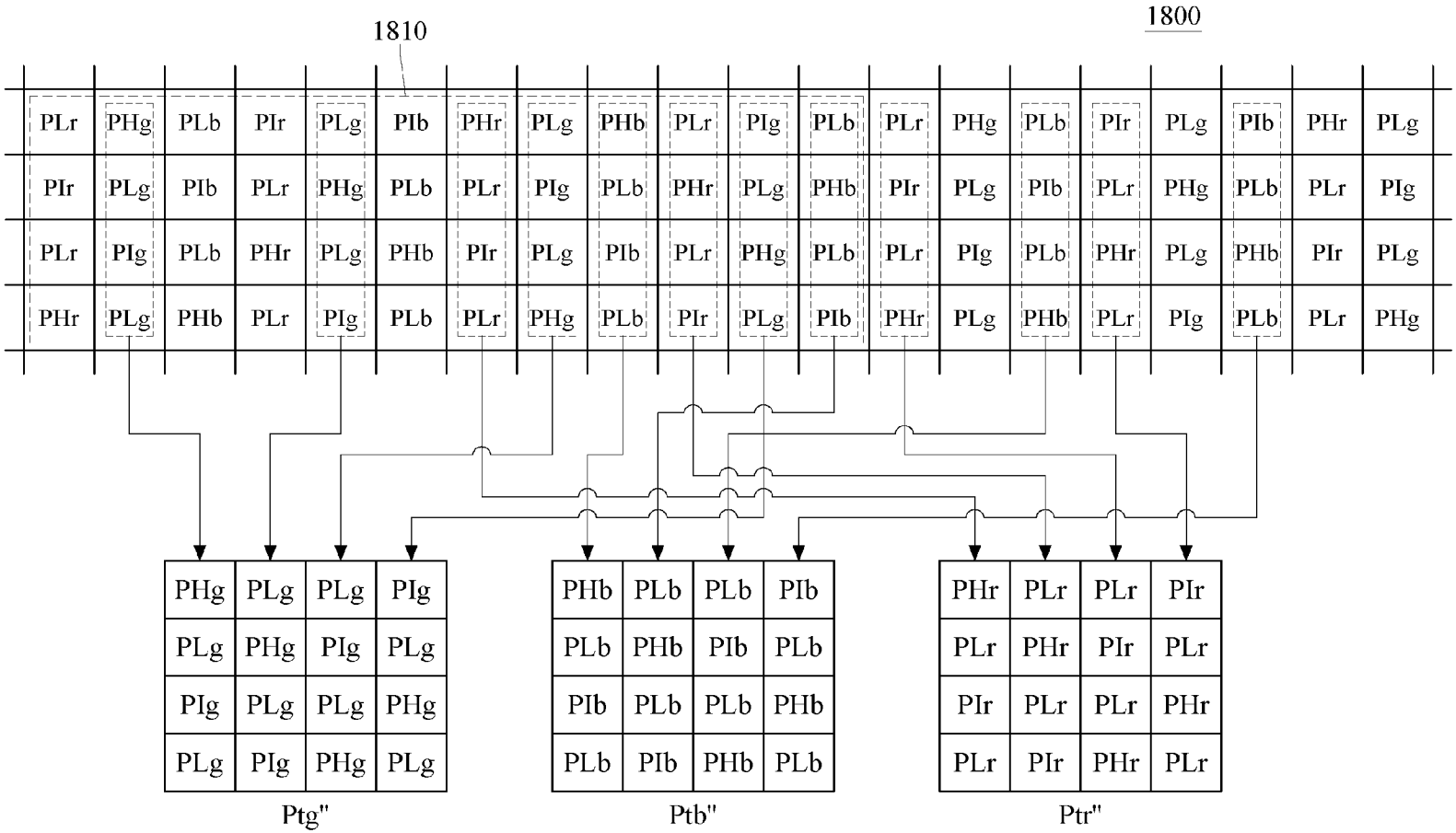
Figure 19:
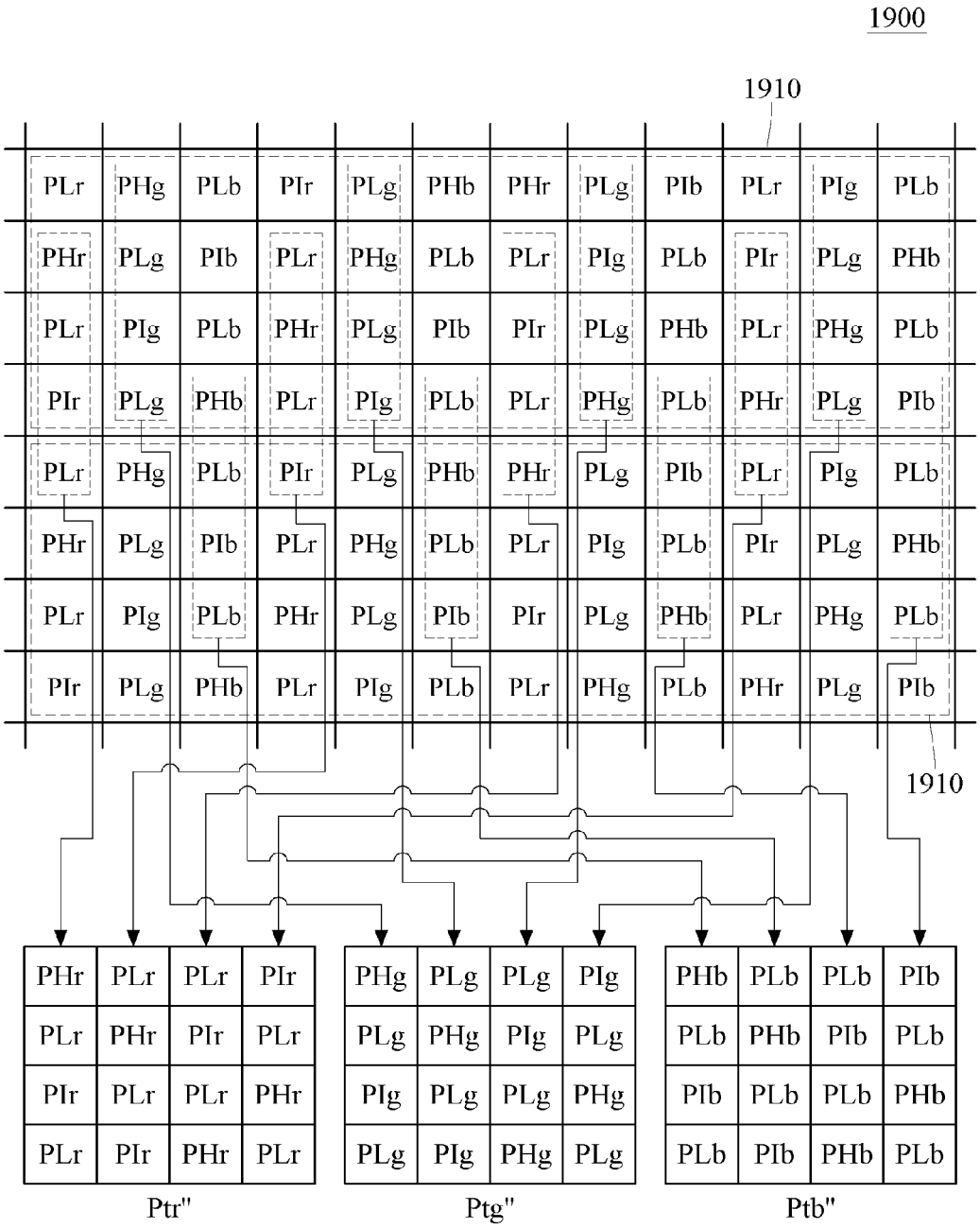

FIG. 18 and FIG. 19 are schematic diagrams of a display panel 1800 and a display panel 1900 according to another two embodiments of the present invention. As shown in FIG. 18, a pixel arrangement manner 1810 may include 48 pixels; pixels PLr, PHg, PLb, PIr, PLg, PIb, PHr, PLg, PHb, PLr, PIg, and PLb are located on a first line from left to right respectively; pixels PIr, PLg, PIb, PLr, PHg, PLb, PLr, PIg, PLb, PHr, PLg, and PHb are located on a second line from left to right respectively; pixels PLr, PIg, PLb, PHr, PLg, PHb, PIr, PLg, PIb, PLr, PHg, and PLb are located on third line from left to right respectively; and pixels PHr, PLg, PHb, PLr, PIg, PLb, PLr, PHg, PLb, PIr, PLg, and PIb are located on a fourth line from left to right respectively. PH, PL, and PI are respectively used to mark gamma functions upon which pixels are driven; r, g, and b are used to mark colors of the pixels. As shown in FIG. 19, a pixel arrangement manner 1910 may include 48 pixels; pixels PLr, PHg, PLb, PIr, PLg, PHb, PHr, PLg, PIb, PLr, Pig, and PLb are located on a first line from left to right respectively; pixels PHr, PLg, PIb, PLr, PHg, PLb, PLr, PIg, PLb, PIr, PLg, and PHb are located on a second line from left to right respectively; pixels PLr, PIg, PLb, PHr, PLg, PIb, PIr, PLg, PHb, PLr, PHg, and PLb are located on third line from left to right respectively; and pixels PIr, PLg, PHb, PLr, PIg, PLb, PLr, PHg, PLb, PHr, PLg, and PIb are located on a fourth line from left to right respectively. PH, PL, and PI are respectively used to mark gamma functions upon which pixels are driven; r, g, and b are used to mark colors of the pixels. The pixel arrangement manners 1810 and 1910 both can enable pixels that display red, green, and blue to be arranged in manners of pixel groups Ptr", Ptg", and Ptb" respectively. The pixel groups Ptr", Ptg", and Ptb" separately correspond to same pixel voltage distribution Vt". By means of adjusting a relative location of a pixel voltage VL corresponding to pixels of a same color, a grid phenomenon can be improved.

Figure 20:
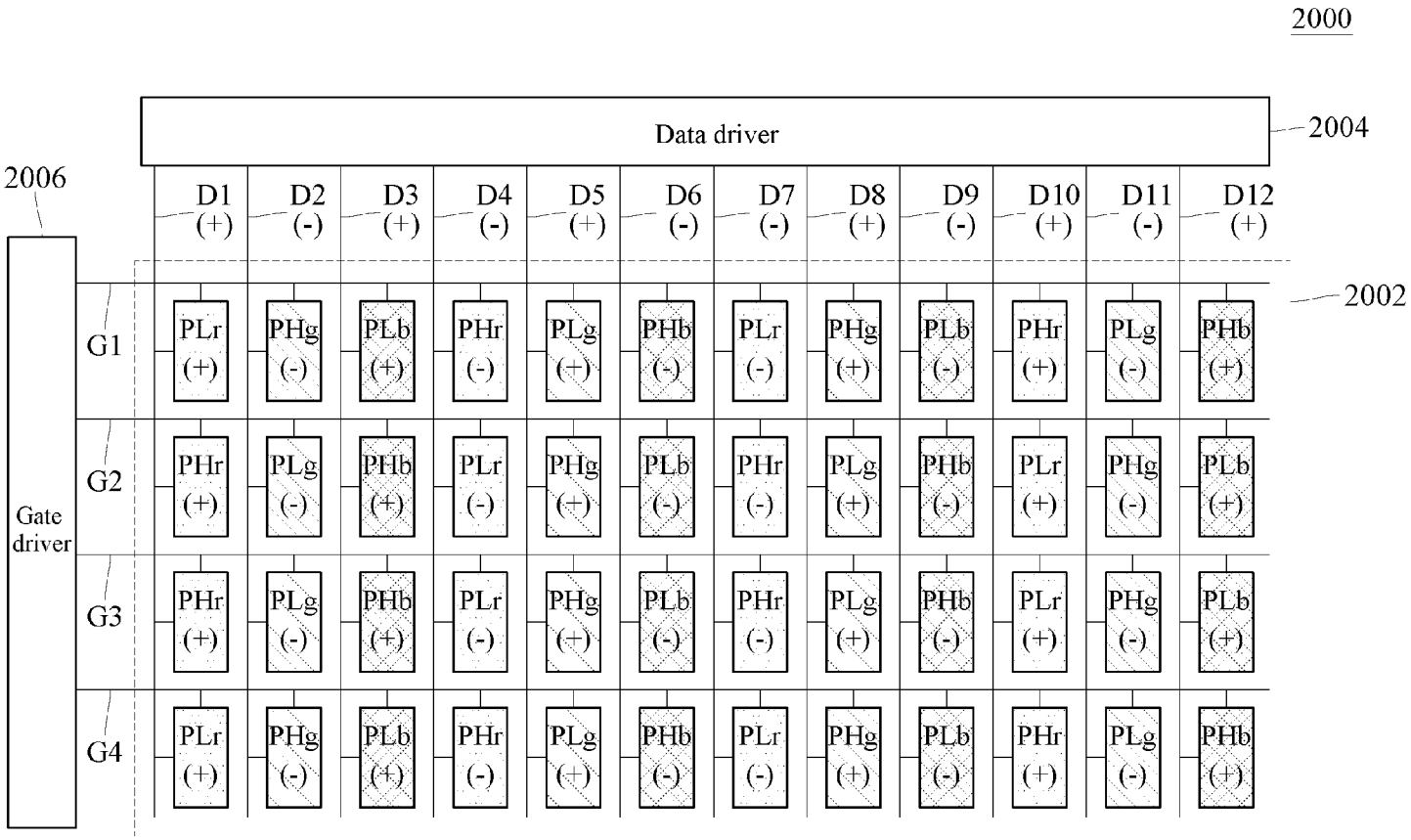

FIG. 20 is a schematic diagram of a display device 2000 according to an embodiment of the present invention. As exemplified in FIG. 20, the display device 2000 includes a plurality of data lines D1 to D12, a plurality of scan lines G1 to G4, and a pixel array 2002; the pixel array 2002 is designed in the pixel arrangement manner 1510, and a pixel voltage VI is set to be the same as a pixel voltage VH. Therefore, a pixel arrangement manner of the display device 2000 is shown in FIG. 20, and the display device 2000 displays pixel voltages in two forms, that is, VL and VH, where a same column of pixels is electrically connected to a same data line. In this embodiment, the display device 2000 is configured with 3×N data lines to be separately electrically connected to 3×N columns of pixels for receiving display data with resolution of M×N. The display device 2000 is configured with M scan lines to be separately electrically connected to M lines of pixels.

In some embodiments, the display device 2000 further includes a data driver 2004 and a gate driver 2006. The data driver 2004 is electrically coupled to the data lines D1 to D12 to output corresponding pixel voltages to corresponding data lines. The gate driver 2006 is electrically coupled to the scan lines G1 to G4 to output corresponding scan signals to corresponding scan lines. In some embodiments, data polarities provided by the data lines D1 to D12 sequentially arranged from left to right are positive (+), negative (−), positive (+), negative (−), positive (+), negative (−), negative (−), positive (+), negative (−), positive (+), negative (−), and positive (+), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Further, because the display device 2000 displays pixel voltages in two forms, that is, VL and VH, pixels, corresponding to the pixel voltage VH, in the pixel array 2002 are defined as pixels PH in a first form, and pixels, corresponding to the pixel voltage VL, in the pixel array 2002 are defined as pixels PL in a second form. Therefore, pixel arrangement in odd-numbered columns of the pixel array 2002 is sequentially PL, PH, PH, and PL, and pixel arrangement in even-numbered columns is sequentially PH, PL, PL, and PH.

Figure 21:
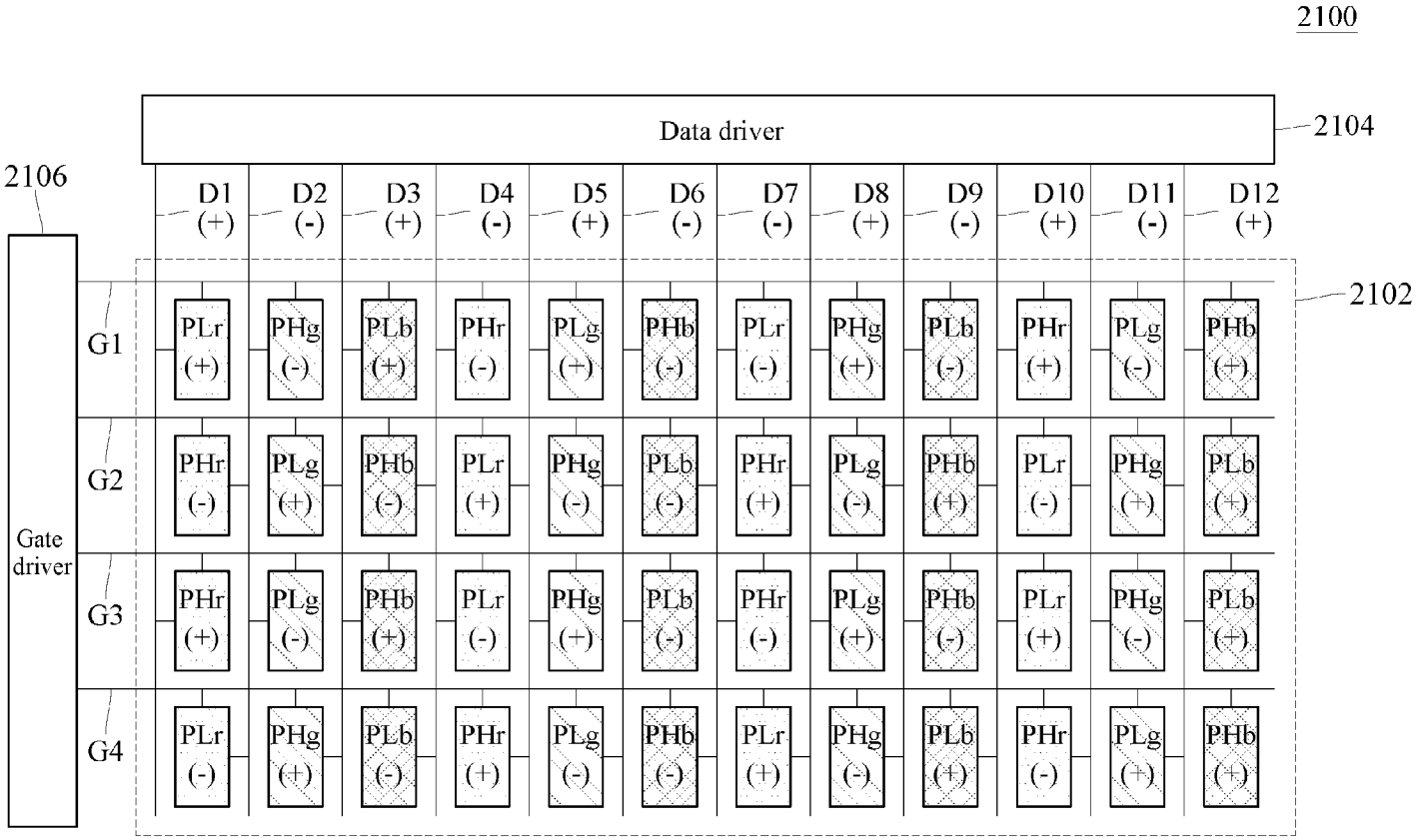

FIG. 21 is a schematic diagram of a display device 2100 according to an embodiment of the present invention. As exemplified in FIG. 21, the display device 2100 includes a plurality of data lines D1 to D12, a plurality of scan lines G1 to G4, and a pixel array 2102; the pixel array 2102 is designed in the pixel arrangement manner 1610, and a pixel voltage VI is set to be the same as a pixel voltage VH. Therefore, a pixel arrangement manner of the display device 2000 is shown in FIG. 20, and the display device 2100 displays pixel voltages in two forms, that is, VL and VH, where pixels in adjacent lines of a same column of subpixels are electrically connected to different data lines. In this embodiment, the display device 2100 is configured with 3×N data lines to be separately electrically connected to 3×N columns of pixels for receiving display data with resolution of M×N. The display device 2100 is configured with M scan lines to be separately electrically connected to M lines of pixels.

In some embodiments, the display device 2100 further includes a data driver 2104 and a gate driver 2106. The data driver 2104 is electrically coupled to the data lines D1 to D12 to output corresponding pixel voltages to corresponding data lines. The gate driver 2106 is electrically coupled to the scan lines G1 to G4 to output corresponding scan signals to corresponding scan lines. In some embodiments, data polarities provided by the data lines D1 to D12 sequentially arranged from left to right are positive (+), negative (−), positive (+), negative (−), positive (+), negative (−), negative (−), positive (+), negative (−), positive (+), negative (−), and positive (+), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 22:
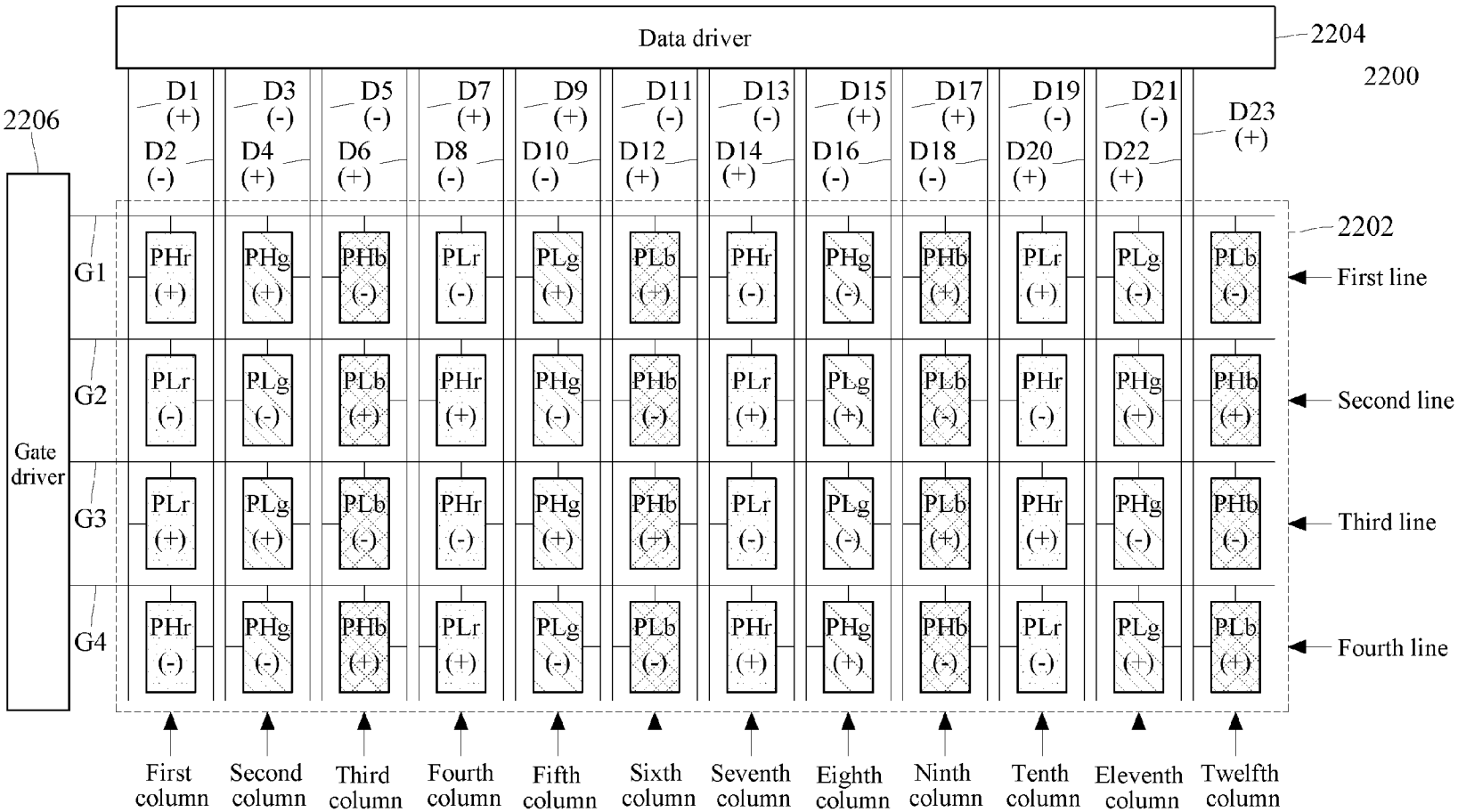

FIG. 22 is a schematic diagram of a display device 2200 according to an embodiment of the present invention. As exemplified in FIG. 22, the display device 2200 includes a plurality of data lines D1 to D23, a plurality of scan lines G1 to G4, and a pixel array 2202; the pixel array 2202 is designed in the pixel arrangement manner 1410, and a pixel voltage VI is set to be the same as a pixel voltage VH. Therefore, a pixel arrangement manner of the display device 2200 is shown in FIG. 22, and the display device 2200 displays pixel voltages in two forms, that is, VL and VH. Two data lines are configured between any left-right adjacent pixels, and any up-down adjacent pixels are electrically connected to different data lines, and each data line is electrically connected to only odd-numbered lines of pixels or only even-numbered lines of pixels. For example, the data lines D1 to D23 are sequentially arranged from left to right; odd-numbered lines of pixels of a red pixel column corresponding to a first column of the pixel array 2202 are separately electrically connected to the data line D1; even-numbered lines of pixels of the red pixel column corresponding to the first column of the pixel array are separately electrically connected to the data line D2; odd-numbered lines of pixels of a green pixel column corresponding to a second column are separately electrically connected to the data line D4; even-numbered lines of pixels of the green pixel column corresponding to the second column are separately electrically connected to the data line D3, and so on, and details are not described herein again. The display device configured in this manner is also called a zig-zag (Zig-zag) display device, but a quantity of the data lines is twice that of pixel columns. In this embodiment, the display device 2200 is configured with 6×N data lines to be separately electrically connected to 3×N columns of pixels for receiving display data with resolution of M×N. The display device 2200 is configured with M scan lines to be separately electrically connected to M lines of pixels.

In some embodiments, the display device 2200 further includes a data driver 2204 and a gate driver 2206. The data driver 2204 is electrically coupled to the data lines D1 to D23 to output corresponding pixel voltages to corresponding data lines. The gate driver 2206 is electrically coupled to the scan lines G1 to G4 to output corresponding scan signals to corresponding scan lines. In some embodiments, data polarities provided by the data lines D1 to D8 sequentially arranged from left to right are positive (+), negative (−), negative (−), positive (+), negative (−), positive (+), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 23:
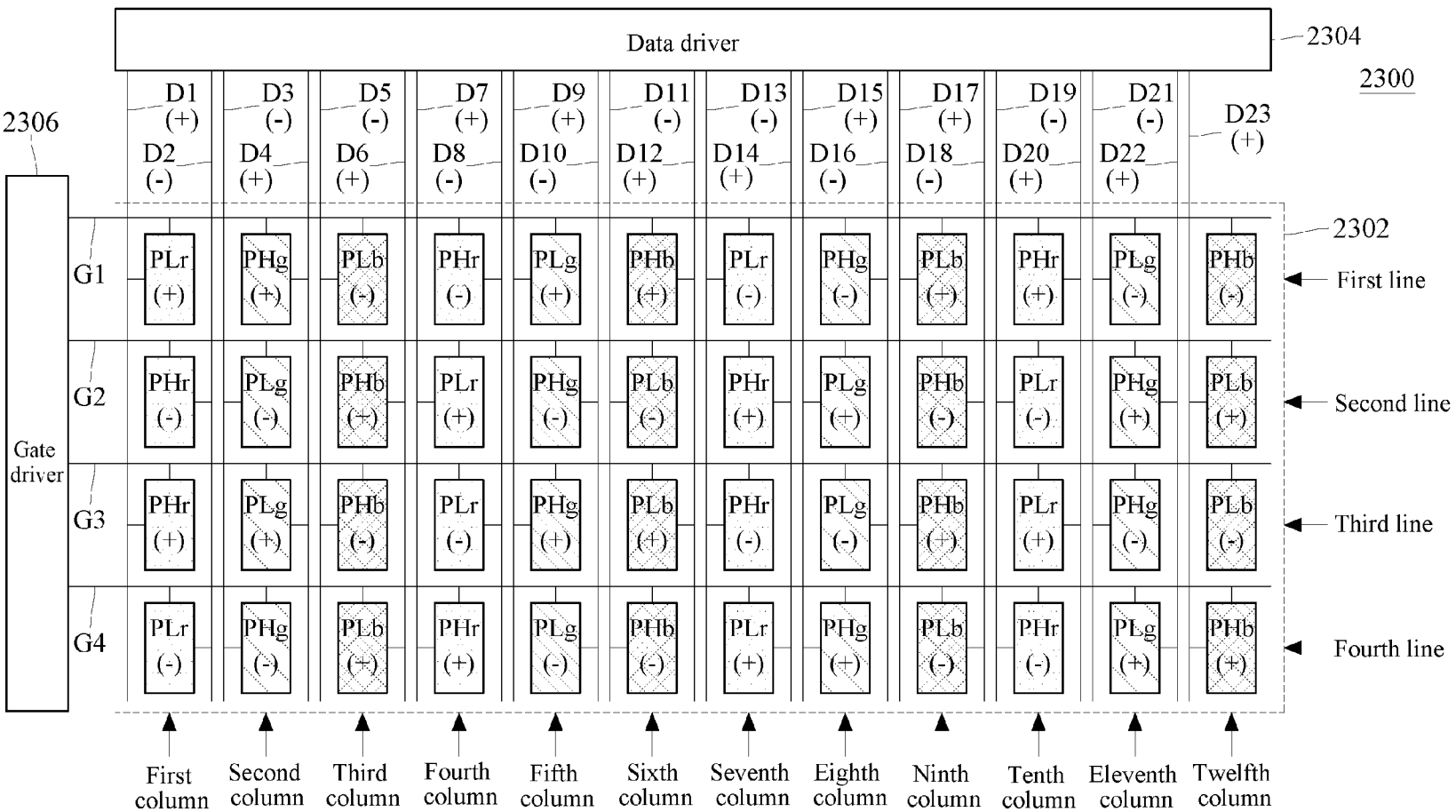

FIG. 23 is a schematic diagram of a display device 2300 according to an embodiment of the present invention. As exemplified in FIG. 23, the display device 2300 includes a plurality of data lines D1 to D23, a plurality of scan lines G1 to G4, and a pixel array 2302; a configuration relationship between data lines and pixels of the display device 2300 is the same as that of the display device 2200, and the display device 2300 differs from the display device 2200 in that, the pixel array 2302 is designed in the pixel arrangement manner 1510, and a pixel voltage VI is set to be the same as a pixel voltage VH. Therefore, a pixel arrangement manner of the display device 2300 is shown in FIG. 23, and the display device 2300 displays pixel voltages in two forms, that is, VL and VH.

In some embodiments, the display device 2300 further includes a data driver 2304 and a gate driver 2306. The data driver 2304 is electrically coupled to the data lines D1 to D23 to output corresponding pixel voltages to corresponding data lines. The gate driver 2306 is electrically coupled to the scan lines G1 to G4 to output corresponding scan signals to corresponding scan lines. In some embodiments, data polarities provided by the data lines D1 to D8 sequentially arranged from left to right are positive (+), negative (−), negative (−), positive (+), negative (−), positive (+), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 24:
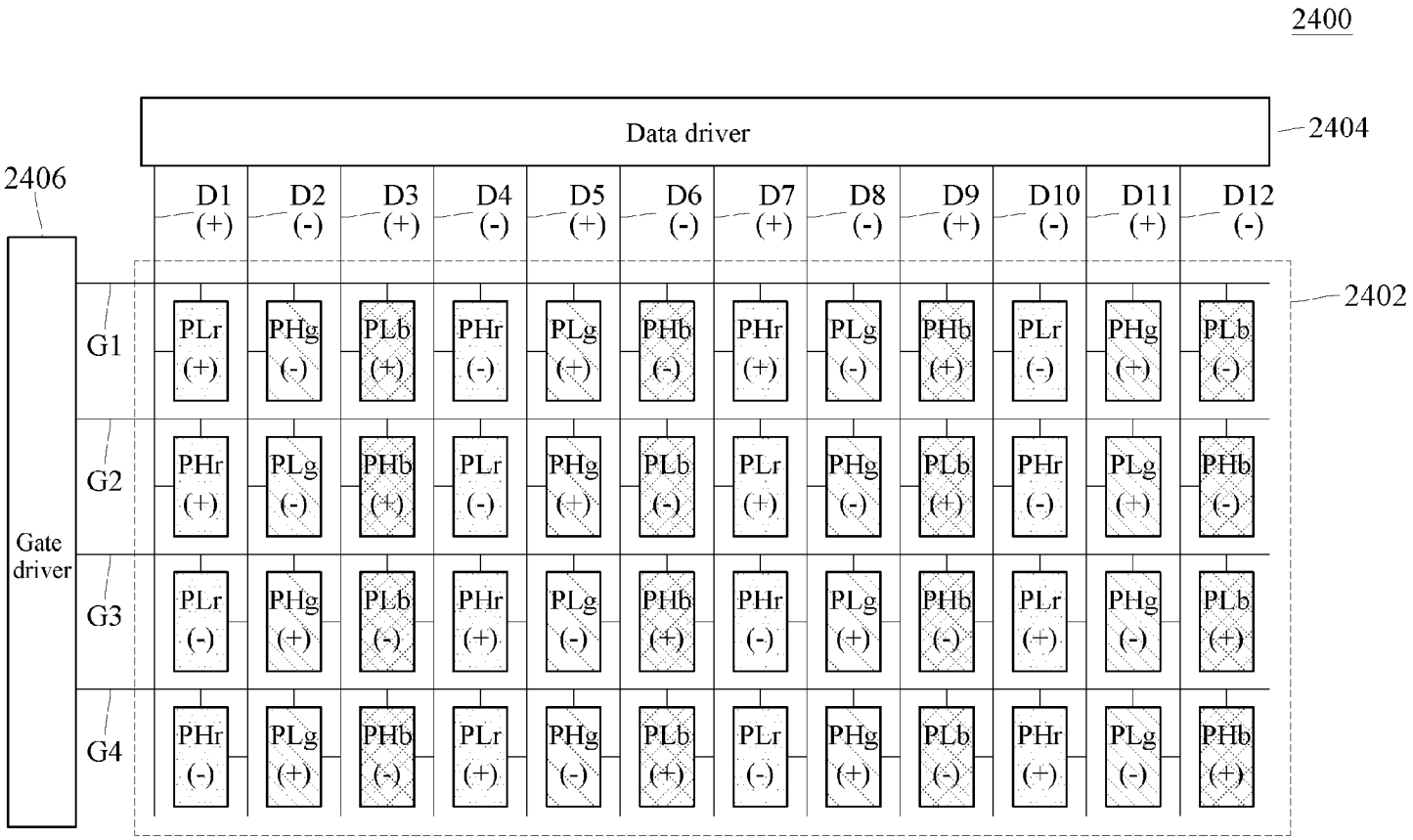

FIG. 24 is a schematic diagram of a display device 2400 according to an embodiment of the present invention. As exemplified in FIG. 24, the display device 2400 includes a plurality of data lines D1 to D12, a plurality of scan lines G1 to G4, and a pixel array 2402; the pixel array 2402 is designed in the pixel arrangement manner 1810, and a pixel voltage VI is set to be the same as a pixel voltage VH. Therefore, a pixel arrangement manner of the display device 2400 is shown in FIG. 24, and the display device 2400 displays pixel voltages in two forms, that is, VL and VH, where pixels in adjacent two lines of a same column of subpixels are electrically connected to different data lines. In this embodiment, the display device 2400 is configured with 3×N data lines to be separately electrically connected to 3×N columns of pixels for receiving display data with resolution of M×N. The display device 2400 is configured with M scan lines to be separately electrically connected to M lines of pixels.

In some embodiments, the display device 2400 further includes a data driver 2404 and a gate driver 2406. The data driver 2404 is electrically coupled to the data lines D1 to D12 to output corresponding pixel voltages to corresponding data lines. The gate driver 2406 is electrically coupled to the scan lines G1 to G4 to output corresponding scan signals to corresponding scan lines. In some embodiments, data polarities provided by the data lines D1 to D12 sequentially arranged from left to right are positive (+), negative (−), positive (+), negative (−), positive (+), negative (−), positive (+), negative (−), positive (+), negative (−), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 25:
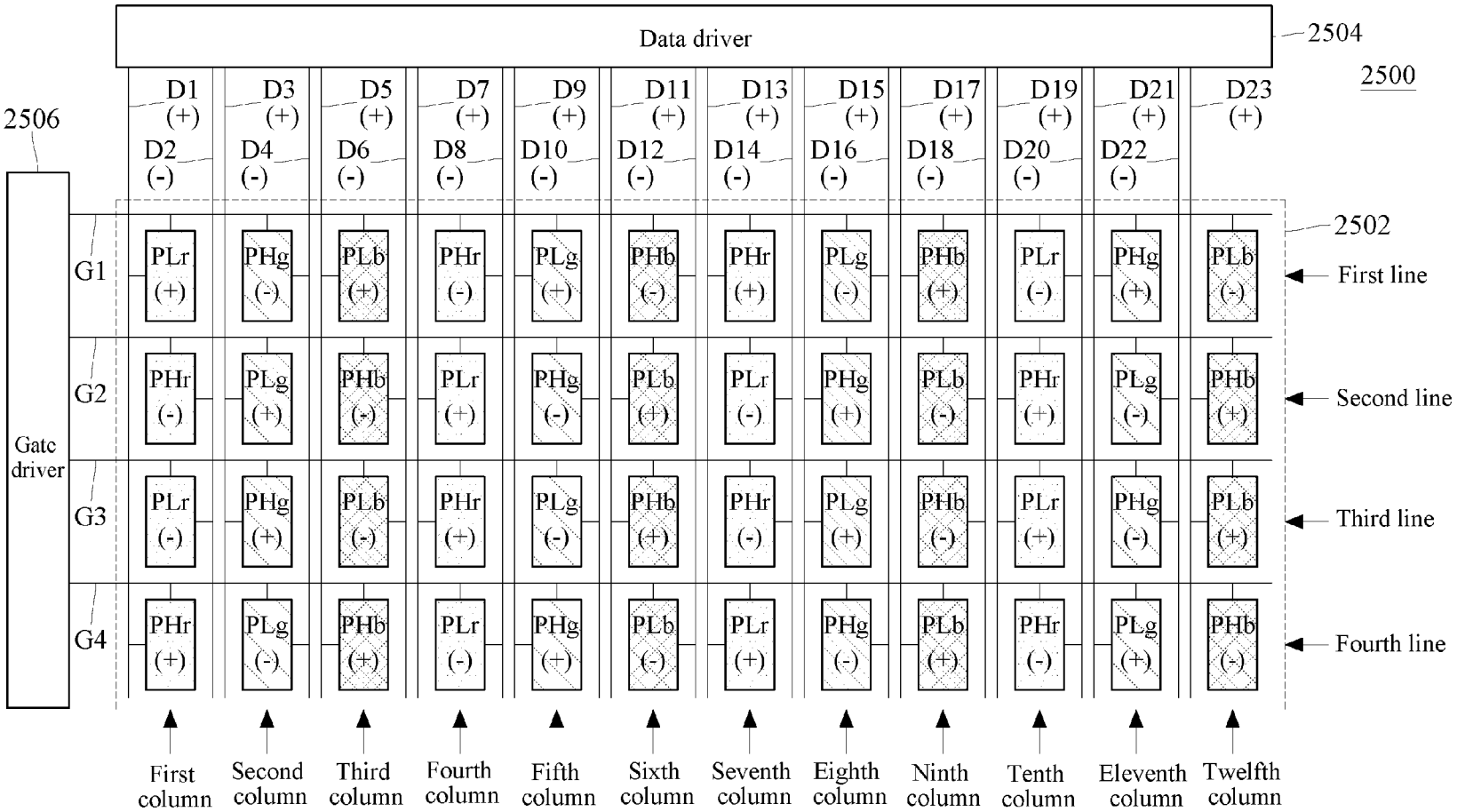

FIG. 25 is a schematic diagram of a display device 2500 according to an embodiment of the present invention. As exemplified in FIG. 25, the display device 2500 includes a plurality of data lines D1 to D23, a plurality of scan lines G1 to G4, and a pixel array 2502; the pixel array 2502 is designed in the pixel arrangement manner 1910, and a pixel voltage VI is set to be the same as a pixel voltage VH. Therefore, a pixel arrangement manner of the display device 2500 is shown in FIG. 25, and the display device 2500 displays pixel voltages in two forms, that is, VL and VH. In addition to the foregoing pixel arrangement manner 1910, the display device 2500 further differs from the display device 2200 in that data lines connected to a third line of pixels of the display device 2500 are the same as data lines connected to a second line of pixels, and data lines connected to a fourth line of pixels are the same as data lines connected to a first line of pixels.

In some embodiments, the display device 2500 further includes a data driver 2504 and a gate driver 2506. The data driver 2504 is electrically coupled to the data lines D1 to D23 to output corresponding pixel voltages to corresponding data lines. The gate driver 2506 is electrically coupled to the scan lines G1 to G4 to output corresponding scan signals to corresponding scan lines. In some embodiments, data polarities provided by the data lines D1 to D8 sequentially arranged from left to right are positive (+), negative (−), positive (+), negative (−), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 26:
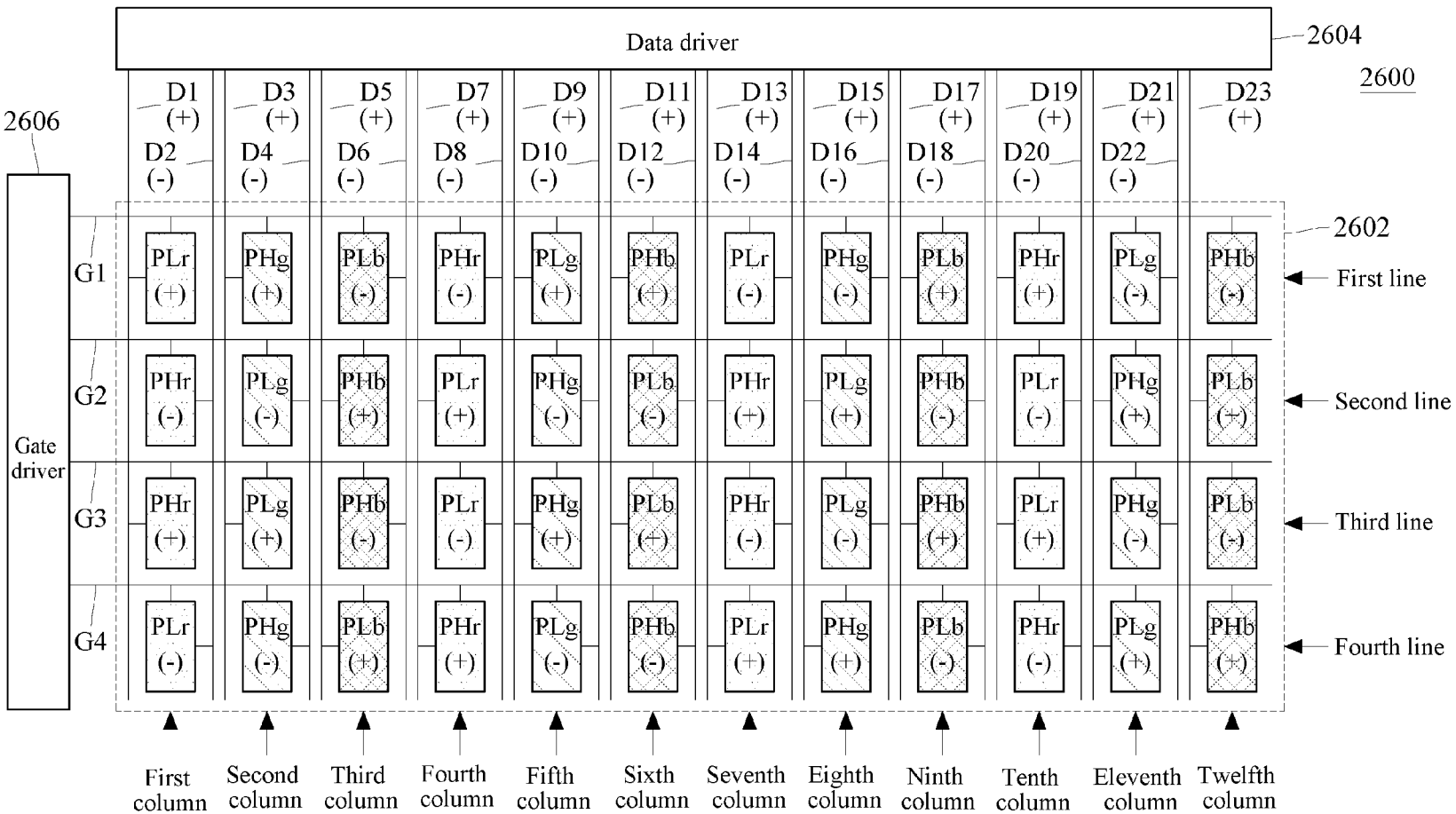

FIG. 26 is a schematic diagram of a display device 2600 according to an embodiment of the present invention. As exemplified in FIG. 26, the display device 2600 includes a plurality of data lines D1 to D23, a plurality of scan lines G1 to G4, and a pixel array 2602; the pixel array 2602 is designed in the pixel arrangement manner 1510, and a pixel voltage VI is set to be the same as a pixel voltage VH. Therefore, a pixel arrangement manner of the display device 2600 is shown in FIG. 26, and the display device 2600 displays pixel voltages in two forms, that is, VL and VH. In some embodiments, the display device 2600 further includes a data driver 2604 and a gate driver 2606. The data driver 2604 is electrically coupled to the data lines D1 to D23 to output corresponding pixel voltages to corresponding data lines. The gate driver 2606 is electrically coupled to the scan lines G1 to G4 to output corresponding scan signals to corresponding scan lines. Two data lines are configured between any left-right adjacent pixels, and any up-down adjacent pixels are electrically connected to different data lines, and each data line is electrically connected to only odd-numbered lines of pixels or only even-numbered lines of pixels. For example, the data lines D1 to D23 are sequentially arranged from left to right; first and third lines of pixels of a red pixel column corresponding to a first column of the pixel array 2602 are separately electrically connected to the data line D1; second and fourth lines of pixels of the red pixel column corresponding to the first column of the pixel array 2602 are separately electrically connected to the data line D2; first and third lines of pixels of a green pixel column corresponding to a second column are separately electrically connected to the data line D3; second and fourth lines of pixels of the green pixel column corresponding to the second column are separately electrically connected to the data line D4, as shown in FIG. 26, and details are not described herein again. In other words, directions in which the first and third lines of the pixel array 2602 are connected to adjacent data lines are sequentially left, left, right, and right, and so on according to the cycle; and directions in which the second and fourth lines of the pixel array 2602 are connected to adjacent data lines are sequentially right, right, left, and left, and so on according to the cycle.

In some embodiments, data polarities provided by the data lines D1 to D8 sequentially arranged from left to right are positive (+), negative (−), positive (+), negative (−), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 27:
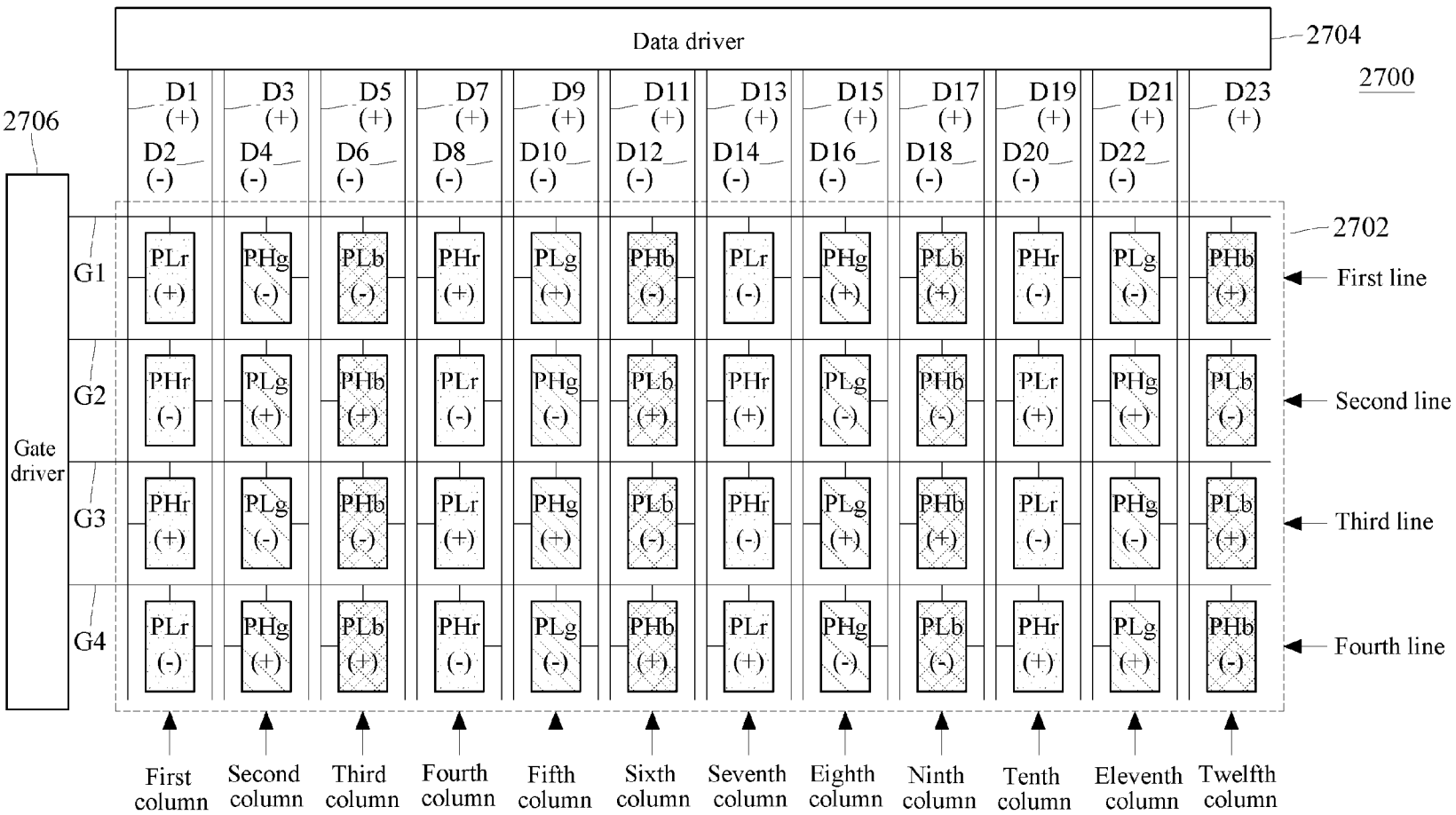

FIG. 27 is a schematic diagram of a display device 2700 according to an embodiment of the present invention. As exemplified in FIG. 27, the display device 2700 includes a plurality of data lines D1 to D23, a plurality of scan lines G1 to G4, and a pixel array 2702; the pixel array 2702 is designed in the pixel arrangement manner 1510, and a pixel voltage VI is set to be the same as a pixel voltage VH. Therefore, a pixel arrangement manner of the display device 2700 is shown in FIG. 27, and the display device 2700 displays pixel voltages in two forms, that is, VL and VH. In some embodiments, the display device 2700 further includes a data driver 2704 and a gate driver 2706. The data driver 2704 is electrically coupled to the data lines D1 to D23 to output corresponding pixel voltages to corresponding data lines. The gate driver 2706 is electrically coupled to the scan lines G1 to G4 to output corresponding scan signals to corresponding scan lines. Two data lines are configured between any left-right adjacent pixels, and any up-down adjacent pixels are electrically connected to different data lines, and each data line is electrically connected to only odd-numbered lines of pixels or only even-numbered lines of pixels. For example, the data lines D1 to D23 are sequentially arranged from left to right; first and third lines of pixels of a red pixel column corresponding to a first column of the pixel array 2702 are separately electrically connected to the data line D1; second and fourth lines of pixels of the red pixel column corresponding to the first column of the pixel array 2702 are separately electrically connected to the data line D2; first and third lines of pixels of a green pixel column corresponding to a second column are separately electrically connected to the data line D4; second and fourth lines of pixels of the green pixel column corresponding to the second column are separately electrically connected to the data line D3, as shown in FIG. 27, and details are not described herein again. In other words, directions in which the first and third lines of the pixel array 2702 are connected to adjacent data lines are sequentially left, right, right, and left, and so on according to the cycle; and directions in which the second and fourth lines of the pixel array 2702 are connected to adjacent data lines are sequentially right, left, left, and right, and so on according to the cycle.

In some embodiments, data polarities provided by the data lines D1 to D8 sequentially arranged from left to right are positive (+), negative (−), positive (+), negative (−), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Figure 28:
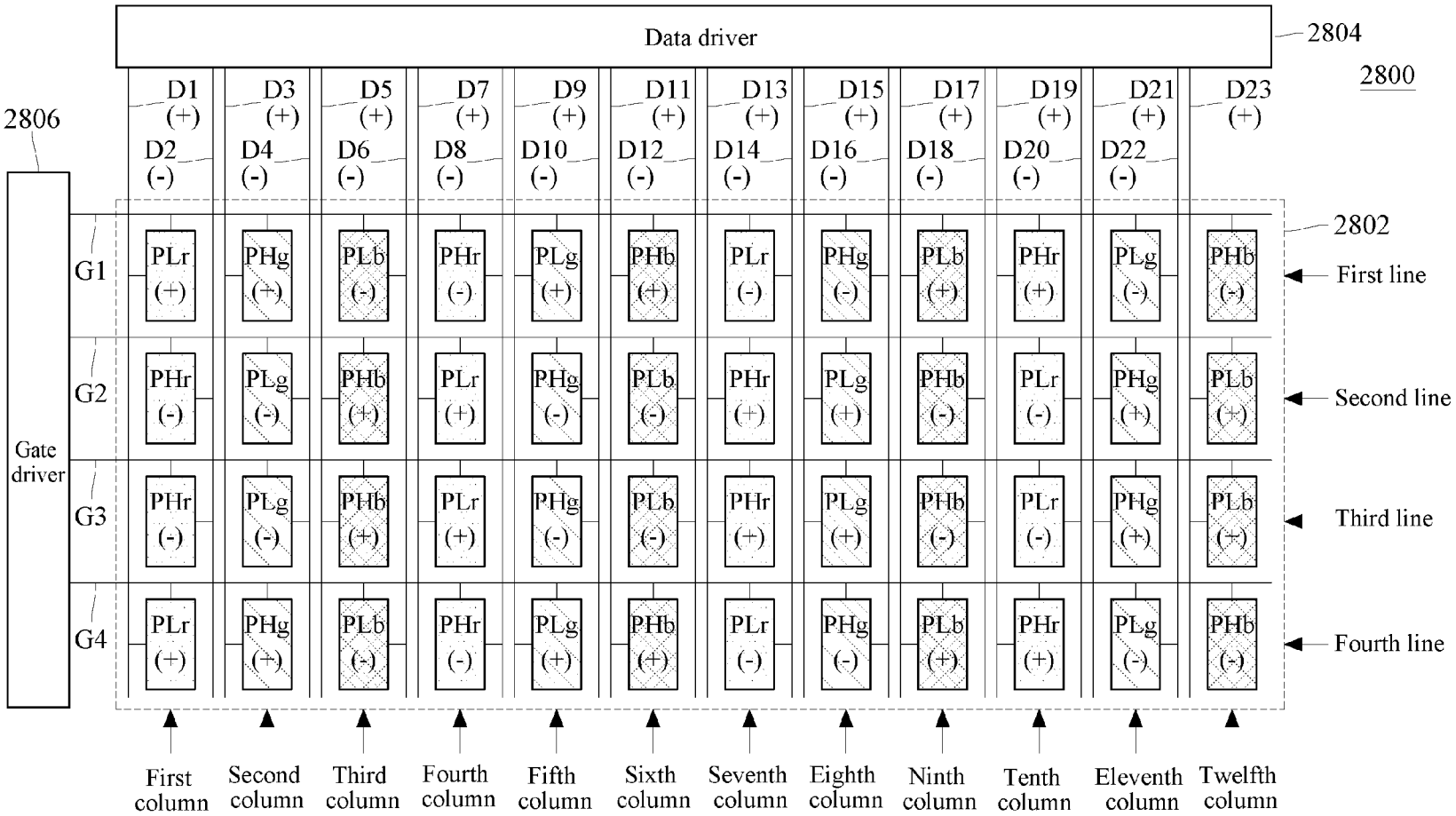

FIG. 28 is a schematic diagram of a display device 2800 according to an embodiment of the present invention. As exemplified in FIG. 28, the display device 2800 includes a plurality of data lines D1 to D23, a plurality of scan lines G1 to G4, and a pixel array 2802; the pixel array 2802 is designed in the pixel arrangement manner 1510, and a pixel voltage VI is set to be the same as a pixel voltage VH. Therefore, a pixel arrangement manner of the display device 2800 is shown in FIG. 28, and the display device 2800 displays pixel voltages in two forms, that is, VL and VH. In some embodiments, the display device 2800 further includes a data driver 2804 and a gate driver 2806. The data driver 2804 is electrically coupled to the data lines D1 to D23 to output corresponding pixel voltages to corresponding data lines. The gate driver 2806 is electrically coupled to the scan lines G1 to G4 to output corresponding scan signals to corresponding scan lines. Two data lines are configured between any left-right adjacent pixels, and any up-down adjacent pixels are electrically connected to different data lines, and each data line is electrically connected to only odd-numbered lines of pixels or only even-numbered lines of pixels. For example, the data lines D1 to D23 are sequentially arranged from left to right; first and fourth lines of pixels of a red pixel column corresponding to a first column of the pixel array 2802 are separately electrically connected to the data line D1; second and third lines of pixels of the red pixel column corresponding to the first column of the pixel array 2802 are separately electrically connected to the data line D2; first and fourth lines of pixels of a green pixel column corresponding to a second column are separately electrically connected to the data line D3; second and third lines of pixels of the green pixel column corresponding to the second column are separately electrically connected to the data line D4, as shown in FIG. 28, and details are not described herein again. In other words, directions in which the first and fourth lines of the pixel array 2802 are connected to adjacent data lines are sequentially left, left, right, and right, and so on according to the cycle; and directions in which the second and third lines of the pixel array 2802 are connected to adjacent data lines are sequentially right, right, left, and left, and so on according to the cycle.

In some embodiments, data polarities provided by the data lines D1 to D8 sequentially arranged from left to right are positive (+), negative (−), positive (+), negative (−), positive (+) and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

FIG. 29 is a schematic diagram of a display device 2900 according to an embodiment of the present invention. As exemplified in FIG. 29, the display device 2900 includes a plurality of data lines D1 to D23, a plurality of scan lines G1 to G4, and a pixel array 2902; the pixel array 2902 is designed in the pixel arrangement manner 1510, and a pixel voltage VI is set to be the same as a pixel voltage VH. Therefore, a pixel arrangement manner of the display device 2900 is shown in FIG. 29, and the display device 2900 displays pixel voltages in two forms, that is, VL and VH. In some embodiments, the display device 2900 further includes a data driver 2904 and a gate driver 2906. The data driver 2904 is electrically coupled to the data lines D1 to D23 to output corresponding pixel voltages to corresponding data lines. The gate driver 2906 is electrically coupled to the scan lines G1 to G4 to output corresponding scan signals to corresponding scan lines. Two data lines are configured between any left-right adjacent pixels, and any up-down adjacent pixels are electrically connected to different data lines, and each data line is electrically connected to only odd-numbered lines of pixels or only even-numbered lines of pixels. For example, the data lines D1 to D23 are sequentially arranged from left to right; first and fourth lines of pixels of a red pixel column corresponding to a first column of the pixel array 2902 are separately electrically connected to the data line D1; second and third lines of pixels of the red pixel column corresponding to the first column of the pixel array 2902 are separately electrically connected to the data line D2; first and fourth lines of pixels of a green pixel column corresponding to a second column are separately electrically connected to the data line D4; second and third lines of pixels of the green pixel column corresponding to the second column are separately electrically connected to the data line D3, as shown in FIG. 29, and details are not described herein again. In other words, directions in which the first and fourth lines of the pixel array 2902 are connected to adjacent data lines are sequentially left, right, right, and left, and so on according to the cycle; and directions in which the second and third lines of the pixel array 2902 are connected to adjacent data lines are sequentially right, left, left, and right, and so on according to the cycle.

In some embodiments, data polarities provided by the data lines D1 to D8 sequentially arranged from left to right are positive (+), negative (−), positive (+), negative (−), positive (+), and negative (−), and so on according to the cycle. Therefore, when the received display data is a pure-color image, for example, a red image is displayed, and polarities of a plurality of pixels PHr are not completely the same, then brightnesses of the plurality of pixels PHr are not completely the same when corresponding to input display data with a same gray scale. Similarly, polarities of a plurality of pixels PLr are not completely the same, and then brightnesses of the plurality of pixels PLr are not completely the same when corresponding to input display data with a same gray scale. By means of the polarity cycle design, a panel has good image quality.

Based on the above, the driving method of the embodiments of the present invention can improve a color washout problem of a side viewing angle, improve a diamond pattern problem and a color breaking problem, and can also maintain a penetration rate at the same time, and is really beneficial for improving disadvantages of existing display panels.

The foregoing are merely preferred embodiments of the present invention, and any equivalent variation and modification made according to the claims of the present invention shall fall within the scope of the present invention.

Compared with the prior art that a single subpixel is divided into two areas in structure to display different brightnesses in the two areas, so as to improve the color washout problem of a side viewing angle, the present invention does not need to divide a single subpixel into two areas; instead, a driver provides pixel voltages that are not completely the same to M×N pixel units when display data is a pure-color image, so that the M×N pixel units display brightnesses that are not completely the same, thereby improving the color washout problem of a side viewing angle. Therefore, compared with the prior art, the present invention can improve a penetration rate of a display panel.

The present invention is disclosed through the foregoing embodiments; however, these embodiments are not intended to limit the present invention. Persons of ordinary skill in the art can make various changes and modifications without departing from the spirit and scope of the present invention. The protection scope of the present invention is subject to the appended claims. For example, a conventional display device uses a charge sharing circuit to make pixel voltages of two areas (for example, a main subpixel area and a secondary subpixel area) of pixels different; or pixels are divided into pixels PH in a first form and pixels PL in a second form (presetting PI=PL) to separately receive a first pixel voltage and a second pixel voltage corresponding thereto. In other words, under the architecture, when display data has a same gray scale, a display device displays four different brightnesses to achieve a wide viewing angle and improve color cast.

What is claimed is:

1. A display device, comprising:

a plurality of pixels, comprising a first column of pixels, a second column of pixels, a third column of pixels, a fourth column of pixels, a fifth column of pixels, a sixth column of pixels, a seventh column of pixels, an eighth column of pixels, a ninth column of pixels, a tenth column of pixels, an eleventh column of pixels, and a twelfth column of pixels that are sequentially configured from left to right;

a plurality of gate lines, configured to output corresponding scan signals to corresponding pixels;

a plurality of data lines, the plurality of data lines comprising 12 successive data lines from left to right, configured to receive a piece of display data and output corresponding pixel voltages respectively to a first column of pixels, a second column of pixels, a third column of pixels, a fourth column of pixels, a fifth column of pixels, a sixth column of pixels, a seventh column of pixels, an eighth column of pixels, a ninth column of pixels, a tenth column of pixels, an eleventh column of pixels, and a twelfth column of pixels;

a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, positive, negative, positive, negative, negative, positive, negative, positive, negative, and positive to the 12 data lines, and each column of pixels comprises at least two of a pixel in a first form (PH) corresponding to a pixel voltage (VH), a pixel in a second form (PL) corresponding to a pixel voltage (VL), and a pixel in a third form (PI) corresponding to a pixel voltage (VI);

wherein a pixel group (Pt) comprises four pixels that display a same color: one pixel in the first form (PH), two pixels in the second form (PL), and one pixel in the third form (PI); and when the display data of the pixel in the first form (PH) of the pixel group (Pt) and that of the two pixels in the second form (PL) of the pixel group (Pt) have same gray scale, the data driver respectively provides a first pixel voltage and a second pixel voltage to the pixel in the first form (PH) of the pixel group (Pt) and the two pixels in the second form (PL) of the pixel group (Pt), and the first pixel voltage is greater than the second pixel voltage.

2. The display device according to claim 1, wherein a same column of pixels is electrically connected to a same data line, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

3. The display device according to claim 1, wherein a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

4. A display device, comprising:

a plurality of pixels, comprising a first column of pixels, a second column of pixels, a third column of pixels, a fourth column of pixels, a fifth column of pixels, a sixth column of pixels, a seventh column of pixels, an eighth column of pixels, a ninth column of pixels, a tenth column of pixels, an eleventh column of pixels, and a twelfth column of pixels that are sequentially configured from left to right;

a plurality of gate lines, configured to output corresponding scan signals to corresponding pixels;

a plurality of data lines, the plurality of data lines comprising 12 successive data lines from left to right, configured to receive a piece of display data and output corresponding pixel voltages respectively to a first column of pixels, a second column of pixels, a third column of pixels, a fourth column of pixels, a fifth column of pixels, a sixth column of pixels, a seventh column of pixels, an eighth column of pixels, a ninth column of pixels, a tenth column of pixels, an eleventh column of pixels, and a twelfth column of pixels;

a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, positive, negative, positive, negative, positive, negative, positive, negative, positive, and negative to the 12 data lines, and each column of pixels comprises at least two of a pixel in a first form (PH) corresponding to a pixel voltage (VH), a pixel in a second form (PL) corresponding to a pixel voltage (VL), and a pixel in a third form (PI) corresponding to a pixel voltage (VI);

wherein a pixel group (Pt) comprises four pixels that display a same color: one pixel in the first form (PH), two pixels in the second form (PL), and one pixel in the third form (PI); and when the display data of the pixel in the first form (PH) of the pixel group (Pt) and that of the two pixels in the second form (PL) of the pixel group (Pt) have same gray scale, the data driver respectively provides a first pixel voltage and a second pixel voltage to the pixel in the first form (PH) of the pixel group (Pt) and the two pixels in the second form (PL) of the pixel group (Pt), and the first pixel voltage is greater than the second pixel voltage.

5. The display device according to claim 4, wherein a same column of pixels is electrically connected to different data lines, and the first column, third column, fifth column, eighth column, tenth column, and twelfth column of pixels sequentially receive the second pixel voltage, the first pixel voltage, the second pixel voltage, and the first pixel voltage, and the second column, fourth column, sixth column, seventh column, ninth column, and eleventh column of pixels sequentially receive the first pixel voltage, the second pixel voltage, the first pixel voltage, and the second pixel voltage, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

6. The display device according to claim 4, wherein there are two data lines between any adjacent columns of pixels, and a same column of pixels is electrically connected to different data lines, and the first column, third column, fifth column, eighth column, tenth column, and twelfth column of pixels sequentially receive the second pixel voltage, the first pixel voltage, the second pixel voltage, and the first pixel voltage, and the second column, fourth column, sixth column, seventh column, ninth column, and eleventh column of pixels sequentially receive the first pixel voltage, the second pixel voltage, the first pixel voltage, and the second pixel voltage, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

7. The display device according to claim 4, wherein there are two data lines between any adjacent columns of pixels, and a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and directions in which odd-numbered lines of pixels are electrically connected to adjacent data lines are sequentially left, left, right, and right, and directions in which even-numbered lines of pixels are electrically connected to adjacent data lines are sequentially right, right, left, and left, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

8. The display device according to claim 4, wherein there are two data lines between any adjacent columns of pixels, and a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and directions in which odd-numbered lines of pixels are electrically connected to adjacent data lines are sequentially left, right, right, and left, and directions in which even-numbered lines of pixels are electrically connected to adjacent data lines are sequentially right, left, left, and right, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

9. The display device according to claim 4, wherein there are two data lines between any adjacent columns of pixels, and a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and directions in which a first line and a fourth line of pixels are electrically connected to adjacent data lines are sequentially left, left, right, and right, and directions in which a second line and a third line of pixels are electrically connected to adjacent data lines are sequentially right, right, left, and left, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

10. The display device according to claim 4, wherein there are two data lines between any adjacent columns of pixels, and a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and directions in which a first line and a fourth line of pixels are electrically connected to adjacent data lines are sequentially left, right, right, and left, and directions in which a second line and a third line of pixels are electrically connected to adjacent data lines are sequentially right, left, left, and right, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

11. A display device, comprising:

a plurality of pixels, comprising a first column of pixels, a second column of pixels, a third column of pixels, a fourth column of pixels, a fifth column of pixels, a sixth column of pixels, a seventh column of pixels, and an eighth column of pixels that are sequentially configured from left to right;

a plurality of gate lines, configured to output corresponding scan signals to corresponding pixels;

a plurality of data lines, the plurality of data lines comprising 8 successive data lines from left to right, configured to receive a piece of display data and output corresponding pixel voltages respectively to a first column of pixels, a second column of pixels, a third column of pixels, a fourth column of pixels, a fifth column of pixels, a sixth column of pixels, a seventh column of pixels, and an eighth column of pixels;

a gate driver, electrically coupled to the gate lines, configured to drive the plurality of pixels; and a data driver, electrically coupled to the data lines, configured to provide data signals to the plurality of pixels, wherein the data driver respectively provides data with polarities of: positive, negative, negative, positive, negative, positive, positive, and negative to the 8 data lines, and each column of pixels comprises at least two of a pixel in a first form (PH) corresponding to a pixel voltage (VH), a pixel in a second form (PL) corresponding to a pixel voltage (VL), and a pixel in a third form (PI) corresponding to a pixel voltage (VI);

wherein a pixel group (Pt) comprises four pixels that display a same color: one pixel in the first form (PH), two pixels in the second form (PL), and one pixel in the third form (PI); and when the display data of the pixel in the first form (PH) of the pixel group (Pt) and that of the two pixels in the second form (PL) of the pixel group (Pt) have same gray scale, the data driver respectively provides a first pixel voltage and a second pixel voltage to the pixel in the first form (PH) of the pixel group (Pt) and the two pixels in the second form (PL) of the pixel group (Pt), and the first pixel voltage is greater than the second pixel voltage.

12. The display device according to claim 11, wherein there are two data lines between any adjacent columns of pixels, and a same column of pixels is electrically connected to different data lines, and each odd-numbered column of pixels sequentially receives the second pixel voltage, the first pixel voltage, the first pixel voltage, and the second pixel voltage, and each even-numbered column of pixels sequentially receives the first pixel voltage, the second pixel voltage, the second pixel voltage, and the first pixel voltage, and directions in which a first line and a third line of pixels are electrically connected to adjacent data lines are sequentially left, right, left, and right, and directions in which a second line and a fourth line of pixels are electrically connected to adjacent data lines are sequentially right, left, right, and left, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

13. The display device according to claim 11, wherein there are two data lines between any adjacent columns of pixels, and a same column of pixels is electrically connected to different data lines, and the first column, second column, and third column of pixels sequentially receive the first pixel voltage, the second pixel voltage, the second pixel voltage, and the first pixel voltage, and the fourth column, the fifth column, and the sixth column of pixels sequentially receive the second pixel voltage, the first pixel voltage, the first pixel voltage, and the second pixel voltage, and directions in which a first line and a third line of pixels are electrically connected to adjacent data lines are sequentially left, right, left, and right, and directions in which a second line and a fourth line of pixels are electrically connected to adjacent data lines are sequentially right, left, right, and left, and each column of pixels comprises the pixel in the first form (PH) corresponding to the pixel voltage (VH), the pixel in the second form (PL) corresponding to the pixel voltage (VL), and the pixel in the third form (PI) corresponding to the pixel voltage (VI).

* * * * *